US009878816B2

(12) United States Patent
Melrose et al.

(10) Patent No.: US 9,878,816 B2
(45) **Date of Patent: *Jan. 30, 2018**

(54) SYSTEMS FOR COMPENSATING FOR VACUUM PRESSURE CHANGES WITHIN A PLASTIC CONTAINER

(71) Applicant: CO2 PAC Ltd., Auckland (NZ)

(72) Inventors: David Melrose, Auckland (NZ); Paul Kelley, Wrightsville, PA (US); John Denner, York, PA (US)

(73) Assignee: CO2 PAC LTD (NZ)

( * ) Notice: Subject to any disclaimer, the term of this patent is extended or adjusted under 35 U.S.C. 154(b) by 423 days.

This patent is subject to a terminal disclaimer.

(21) Appl. No.: 14/142,882

(22) Filed: Dec. 29, 2013

(65) Prior Publication Data

US 2014/0109517 A1 Apr. 24, 2014

Related U.S. Application Data

(60) Continuation of application No. 13/775,995, filed on Feb. 25, 2013, now Pat. No. 9,802,730, which is a (Continued)

(30) Foreign Application Priority Data

Sep. 30, 2002 (NZ) ..... 521694

(51) Int. Cl.
*B65B 3/02* (2006.01)
*B65D 1/46* (2006.01)

(Continued)

(52) U.S. Cl.
CPC ..... *B65D 1/46* (2013.01); *B65B 3/022* (2013.01); *B65B 3/04* (2013.01); *B65B 7/2835* (2013.01);

(Continued)

(58) Field of Classification Search
CPC ..... B65D 1/46; B65D 1/0246; B65D 1/0261; B65D 1/0276; B65D 1/42; B65D 23/102;

(Continued)

(56) References Cited

U.S. PATENT DOCUMENTS 1,499,239 A 6/1924 Malmquist
2,142,257 A 1/1937 Saeta (Continued)

FOREIGN PATENT DOCUMENTS

AU 2002257159 4/2003
CA 2077717 3/1993

(Continued)

OTHER PUBLICATIONS

Wartenhorst, F., International Search Report for PCT/US2004/024581 dated Jul. 25, 2005, ISA/EP, 2 pp.

(Continued)

*Primary Examiner* — Sameh Tawfik
(74) *Attorney, Agent, or Firm* — Henricks, Slavin & Holmes LLP

(57) ABSTRACT

A plastic container comprises an upper portion including a finish adapted to receive a closure, a lower portion including a base, and a sidewall extending between the upper portion and the lower portion. The upper portion, the lower portion, and the sidewall define an interior volume for storing liquid contents. The plastic container further comprises a pressure panel located on the container and moveable between an initial position and an activated position. The pressure panel is located in the initial position prior to filling the container, and is moved to the activated position after filling and sealing the container. Moving the pressure panel from the initial position to the activated position reduces the internal volume of the container and creates a positive pressure inside the container. The positive pressure reinforces the (Continued)

sidewall. A method of processing a container is also disclosed.

17 Claims, 30 Drawing Sheets

Related U.S. Application Data division of application No. 11/413,124, filed on Apr. 28, 2006, now Pat. No. 8,381,940, which is a continuation-in-part of application No. 10/529,198, filed as application No. PCT/NZ03/00220 on Sep. 30, 2003, now Pat. No. 8,152,010, said application No. 11/413,124 is a continuation-in-part of application No. 10/566,294, filed as application No. PCT/US2004/024581 on Jul. 30, 2004, now Pat. No. 7,726,106.

(60) Provisional application No. 60/551,771, filed on Mar. 11, 2004, provisional application No. 60/491,179, filed on Jul. 30, 2003.

(51) Int. Cl.

| | |
|---|---|
| ***B65B 7/28*** | (2006.01) |
| ***B65B 61/24*** | (2006.01) |
| ***B65D 1/02*** | (2006.01) |
| ***B65D 79/00*** | (2006.01) |
| ***B65D 1/42*** | (2006.01) |
| ***B67C 7/00*** | (2006.01) |
| ***B65B 3/04*** | (2006.01) |
| ***B65B 63/08*** | (2006.01) |
| ***B65D 23/10*** | (2006.01) |
| ***B67B 3/20*** | (2006.01) |
| *B67C 3/22* | (2006.01) |

(52) U.S. Cl.

CPC ..... *B65B 61/24* (2013.01); *B65B 63/08* (2013.01); *B65D 1/0246* (2013.01); *B65D 1/0261* (2013.01); *B65D 1/0276* (2013.01); *B65D 1/42* (2013.01); *B65D 23/102* (2013.01); *B65D 79/005* (2013.01); *B67B 3/20* (2013.01); *B67C 7/00* (2013.01); *B67C 2003/226* (2013.01)

(58) Field of Classification Search

CPC ..... B65B 3/022; B65B 3/04; B65B 7/2835; B65B 61/24; B65B 63/08; B67B 3/20; B67C 7/00; B67C 2003/226

USPC ..... 53/440

See application file for complete search history.

(56) References Cited

U.S. PATENT DOCUMENTS

| | | | |
|---|---|---|---|
| D110,624 | S | 7/1938 | Mekeel, Jr. |
| 2,124,959 | A | 7/1938 | Vogel |
| 2,378,324 | A | 6/1945 | Ray et al. |
| 2,880,902 | A | 4/1959 | Owsen |
| 2,960,248 | A | 11/1960 | Kuhlman |
| 2,971,671 | A | 2/1961 | Shakman |
| 2,982,440 | A | 5/1961 | Harrison |
| 3,043,461 | A | 7/1962 | Glassco |
| 3,081,002 | A | 3/1963 | Tauschinski et al. |
| 3,090,478 | A | 5/1963 | Stanley |
| 3,142,371 | A | 7/1964 | Rice et al. |
| 3,174,655 | A | 3/1965 | Hurschman |
| 3,198,861 | A | 8/1965 | Marvel |
| 3,201,111 | A | 8/1965 | Afton |
| 3,301,293 | A | 1/1967 | Santelli |
| 3,325,031 | A | 6/1967 | Singier et al. |
| 3,397,724 | A | 8/1968 | Bolen et al. |
| 3,409,167 | A | 11/1968 | Blanchard |
| 3,417,893 | A | 12/1968 | Lieberman |
| 3,426,939 | A | 2/1969 | Young |
| 3,441,192 | A | 4/1969 | Metzler et al. |
| 3,441,982 | A | 5/1969 | Sagara et al. |
| 3,468,443 | A | 9/1969 | Marcus |
| 3,483,908 | A | 12/1969 | Donovan |
| 3,485,355 | A | 12/1969 | Stewart |
| 3,693,828 | A | 9/1972 | Kneusel et al. |
| 3,704,140 | A | 11/1972 | Petit et al. |
| 3,727,783 | A | 4/1973 | Carmichael |
| 3,819,789 | A | 6/1974 | Parker |
| 3,883,033 | A | 5/1975 | Brown |
| 3,904,069 | A | 9/1975 | Toukmanian |
| 3,918,920 | A | 11/1975 | Barber |
| 3,935,955 | A | 2/1976 | Das |
| 3,941,237 | A | 3/1976 | Macgregor, Jr. |
| 3,942,673 | A | 3/1976 | Lyu et al. |
| 3,949,033 | A | 4/1976 | Uhlig |
| 3,956,441 | A | 5/1976 | Uhlig |
| 4,036,926 | A | 7/1977 | Chang |
| 4,037,752 | A | 7/1977 | Dulmaine et al. |
| 4,117,062 | A | 9/1978 | Uhlig |
| 4,123,217 | A | 10/1978 | Fischer et al. |
| 4,125,632 | A | 11/1978 | Vosti et al. |
| 4,134,510 | A | 1/1979 | Chang |
| 4,158,624 | A | 6/1979 | Ford et al. |
| 4,170,622 | A | 10/1979 | Uhlig et al. |
| 4,174,782 | A | 11/1979 | Obsomer |
| 4,219,137 | A | 8/1980 | Hutchens |
| 4,231,483 | A | 11/1980 | Dechenne et al. |
| 4,247,012 | A | 1/1981 | Alberghini |
| 4,301,933 | A | 11/1981 | Yoshino et al. |
| 4,318,489 | A | 3/1982 | Snyder et al. |
| 4,318,882 | A | 3/1982 | Agrawal et al. |
| 4,321,483 | A | 3/1982 | Dugan |
| 4,338,765 | A | 7/1982 | Ohmori et al. |
| 4,355,728 | A | 10/1982 | Ota et al. |
| 4,377,191 | A | 3/1983 | Yamaguchi |
| 4,378,328 | A | 3/1983 | Przytulla |
| 4,381,061 | A | 4/1983 | Cerny et al. |
| D269,158 | S | 5/1983 | Gaunt et al. |
| 4,386,701 | A | 6/1983 | Galer et al. |
| 4,412,866 | A | 11/1983 | Schoenrock et al. |
| 4,436,216 | A | 3/1984 | Chang |
| 4,444,308 | A | 4/1984 | MacEwen |
| 4,450,878 | A | 5/1984 | Takada et al. |
| 4,465,199 | A | 8/1984 | Aoki |
| 4,497,621 | A | 2/1985 | Kudert et al. |
| 4,497,855 | A | 2/1985 | Agrawal et al. |
| 4,525,401 | A | 6/1985 | Pocock et al. |
| 4,542,029 | A | 9/1985 | Caner et al. |
| 4,547,333 | A | 10/1985 | Takada |
| 4,610,366 | A | 9/1986 | Estes et al. |
| 4,628,669 | A | 12/1986 | Herron et al. |
| 4,642,968 | A | 2/1987 | McHenry et al. |
| 4,645,078 | A | 2/1987 | Reyner |
| 4,667,454 | A | 5/1987 | McHenry et al. |
| 4,684,025 | A | 8/1987 | Copland et al. |
| 4,685,273 | A | 8/1987 | Caner et al. |
| D292,378 | S | 10/1987 | Brandt et al. |
| 4,701,121 | A | 10/1987 | Jakobsen et al. |
| 4,723,661 | A | 2/1988 | Hoppmann et al. |
| 4,724,855 | A | 2/1988 | Jackson et al. |
| 4,747,507 | A | 5/1988 | Fitzgerald et al. |
| 4,749,092 | A | 6/1988 | Sugiura et al. |
| 4,769,206 | A | 9/1988 | Reymann et al. |
| 4,773,458 | A | 9/1988 | Touzani |
| 4,785,949 | A | 11/1988 | Krishnakumar et al. |
| 4,785,950 | A | 11/1988 | Miller et al. |
| 4,807,424 | A | 2/1989 | Robinson et al. |
| 4,813,556 | A | 3/1989 | Lawrence |
| 4,831,050 | A | 5/1989 | Bettle |
| 4,836,398 | A | 6/1989 | Leftault, Jr. et al. |
| 4,840,289 | A | 6/1989 | Fait et al. |
| 4,850,493 | A | 7/1989 | Howard, Jr. |
| 4,850,494 | A | 7/1989 | Howard, Jr. |
| 4,865,206 | A | 9/1989 | Behm et al. |
| 4,867,323 | A | 9/1989 | Powers |

(56) References Cited

U.S. PATENT DOCUMENTS 4,875,576 A 10/1989 Torgrimson et al.
4,880,129 A 11/1989 McHenry et al.
4,887,730 A 12/1989 Touzani
4,892,205 A 1/1990 Powers et al.
4,896,205 A 1/1990 Weber
4,921,147 A 5/1990 Poirier
4,962,863 A 10/1990 Wendling et al.
4,967,538 A 11/1990 Leftault, Jr. et al.
4,976,538 A 12/1990 Ake
4,978,015 A 12/1990 Walker
4,997,692 A 3/1991 Yoshino
5,004,109 A 4/1991 Bartley
5,005,716 A 4/1991 Eberle
5,014,868 A 5/1991 Wittig et al.
5,024,340 A 6/1991 Alberghini et al.
5,033,254 A 7/1991 Zenger
5,060,453 A 10/1991 Alberghini et al.
5,067,622 A 11/1991 Garver et al.
5,090,180 A 2/1992 Sorensen
5,092,474 A 3/1992 Leigner
5,122,327 A 6/1992 Spina et al.
5,133,468 A 7/1992 Brunson et al.
5,141,121 A 8/1992 Brown et al.
5,178,290 A 1/1993 Ota et al.
5,199,587 A 4/1993 Ota et al.
5,199,588 A 4/1993 Hayashi
5,201,438 A 4/1993 Norwood et al.
5,217,737 A 6/1993 Gygax et al.
5,234,126 A 8/1993 Jonas et al.
5,244,106 A 9/1993 Takacs
5,251,424 A 10/1993 Zenger et al.
5,255,889 A 10/1993 Collette et al.
5,261,544 A 11/1993 Weaver, Jr.
5,279,433 A 1/1994 Krishnakumar et al.
5,281,387 A 1/1994 Collette et al.
5,310,043 A 5/1994 Alcorn
5,310,068 A 5/1994 Saghri
5,333,761 A 8/1994 Davis et al.
5,337,909 A 8/1994 Vailliencourt
5,337,924 A 8/1994 Dickie
5,341,946 A 8/1994 Valliencourt et al.
5,389,332 A 2/1995 Amari et al.
5,392,937 A 2/1995 Prevot et al.
5,407,086 A 4/1995 Ota et al.
5,411,699 A 5/1995 Collette et al.
5,454,481 A 10/1995 Hsu
5,472,105 A 12/1995 Krishnakumar et al.
5,472,181 A 12/1995 Lowell
RE35,140 E 1/1996 Powers, Jr.
5,484,052 A 1/1996 Pawloski et al.
5,492,245 A 2/1996 Kalkanis
5,503,283 A 4/1996 Semersky
5,543,107 A 8/1996 Malik et al.
5,573,129 A 11/1996 Nagata et al.
5,593,063 A 1/1997 Claydon et al.
5,598,941 A 2/1997 Semersky et al.
5,632,397 A 5/1997 Fandeux et al.
5,642,826 A 7/1997 Melrose
5,672,730 A 9/1997 Cottman
5,687,874 A 11/1997 Omori et al.
5,690,244 A 11/1997 Darr
5,704,504 A 1/1998 Bueno
5,713,480 A 2/1998 Petre et al.
5,730,314 A 3/1998 Wiemann et al.
5,730,914 A 3/1998 Ruppmann, Sr.
5,735,420 A 4/1998 Nakamaki et al.
5,737,827 A 4/1998 Kuse et al.
5,746,339 A 5/1998 Petre et al.
5,758,802 A 6/1998 Wallays
5,762,221 A 6/1998 Tobias et al.
5,780,130 A 7/1998 Hansen et al.
5,785,197 A 7/1998 Slat
5,819,507 A 10/1998 Kaneko
5,829,614 A 11/1998 Collette et al.
5,858,300 A 1/1999 Shimizu et al.
5,860,556 A 1/1999 Robbins, III
5,887,739 A 3/1999 Prevot et al.
5,888,598 A 3/1999 Brewster et al.
5,897,090 A 4/1999 Smith et al.
5,906,286 A 5/1999 Matsuno et al.
5,908,128 A 6/1999 Krishnakumar et al.
D415,030 S 10/1999 Searle et al.
5,971,184 A 10/1999 Krishnakumar et al.
5,976,653 A 11/1999 Collette et al.
RE36,639 E 4/2000 Okhai
6,045,001 A 4/2000 Seul
6,065,624 A 5/2000 Steinke
6,068,110 A 5/2000 Kumakiri et al.
6,074,596 A 6/2000 Jacquet
6,077,554 A 6/2000 Wiemann et al.
6,090,334 A 7/2000 Matsuno et al.
6,105,815 A 8/2000 Mazda et al.
6,176,382 B1 * 1/2001 Bazlur Rashid ..... B65D 1/0276 215/373
6,213,325 B1 4/2001 Cheng et al.
6,217,818 B1 4/2001 Collette et al.
6,228,317 B1 5/2001 Smith et al.
6,230,912 B1 5/2001 Rashid
6,277,321 B1 8/2001 Valliencourt et al.
6,298,638 B1 10/2001 Bettle
6,375,025 B1 4/2002 Mooney
6,390,316 B1 5/2002 Mooney
6,413,466 B1 7/2002 Boyd et al.
6,439,413 B1 8/2002 Prevot et al.
6,467,639 B2 10/2002 Mooney
6,485,669 B1 11/2002 Boyd et al.
6,502,369 B1 1/2003 Andison et al.
6,514,451 B1 2/2003 Boyd et al.
6,585,124 B2 7/2003 Boyd et al.
6,595,380 B2 7/2003 Silvers
6,612,451 B2 9/2003 Tobias et al.
6,635,217 B1 10/2003 Britton
6,662,960 B2 12/2003 Hong et al.
6,749,075 B2 6/2004 Bourque et al.
6,749,780 B2 6/2004 Tobias
6,763,968 B1 7/2004 Boyd et al.
6,769,561 B2 * 8/2004 Futral ..... B65D 1/0276 215/371
6,779,673 B2 8/2004 Melrose et al.
6,923,334 B2 8/2005 Melrose et al.
6,935,525 B2 8/2005 Trude
6,942,116 B2 9/2005 Lisch et al.
6,983,858 B2 1/2006 Slat et al.
7,051,073 B1 5/2006 Dutta
7,051,889 B2 5/2006 Boukobza
D522,368 S 6/2006 Darr et al.
7,073,675 B2 7/2006 Trude
7,077,279 B2 7/2006 Melrose
7,137,520 B1 11/2006 Melrose
7,140,505 B2 11/2006 Roubal et al.
7,150,372 B2 12/2006 Lisch et al.
7,159,374 B2 1/2007 Abercrombie, III et al.
D538,168 S 3/2007 Davis et al.
D547,664 S 7/2007 Davis et al.
7,350,657 B2 4/2008 Eaton et al.
7,367,365 B2 5/2008 Slat et al.
D572,599 S 7/2008 Melrose
7,416,089 B2 8/2008 Kraft et al.
D576,041 S 9/2008 Melrose et al.
7,451,886 B2 11/2008 Lisch et al.
7,520,400 B2 4/2009 Young et al.
7,543,713 B2 6/2009 Trude et al.
7,574,846 B2 8/2009 Sheets et al.
7,717,282 B2 5/2010 Melrose
7,726,106 B2 6/2010 Kelley et al.
7,735,304 B2 6/2010 Kelley et al.
7,799,264 B2 9/2010 Trude
7,900,425 B2 3/2011 Bysick et al.
7,926,243 B2 4/2011 Kelley et al.
D641,244 S 7/2011 Bysick et al.
8,017,065 B2 9/2011 Trude et al.
8,096,098 B2 1/2012 Kelley et al.
8,127,955 B2 3/2012 Denner et al.
8,152,010 B2 4/2012 Melrose

(56) References Cited

U.S. PATENT DOCUMENTS

| | | | | |
|---|---|---|---|---|
| 8,171,701 | B2 | 5/2012 | Kelley et al. | |
| 8,381,940 | B2 | 2/2013 | Melrose et al. | |
| 8,429,880 | B2 | 4/2013 | Kelley et al. | |
| 8,584,879 | B2 | 11/2013 | Melrose et al. | |
| 8,627,944 | B2 | 1/2014 | Kelley et al. | |
| 8,720,163 | B2 | 5/2014 | Melrose et al. | |
| 8,726,616 | B2 | 5/2014 | Bysick et al. | |
| 8,962,114 | B2 | 2/2015 | Nahill et al. | |
| 9,090,363 | B2 | 7/2015 | Kelley et al. | |
| 9,145,223 | B2 | 9/2015 | Melrose et al. | |
| 9,193,496 | B2 | 11/2015 | Melrose | |
| 9,211,968 | B2 | 12/2015 | Melrose | |
| 9,624,018 | B2 | 4/2017 | Melrose | |
| 2001/0035391 | A1 | 11/2001 | Young et al. | |
| 2002/0074336 | A1* | 6/2002 | Silvers | B65D 79/005 220/623 |
| 2002/0096486 | A1 | 7/2002 | Bourque et al. | |
| 2002/0153343 | A1* | 10/2002 | Tobias | B65D 1/0284 215/375 |
| 2002/0158038 | A1 | 10/2002 | Heisel et al. | |
| 2003/0015491 | A1 | 1/2003 | Melrose et al. | |
| 2003/0121881 | A1 | 7/2003 | Higuchi | |
| 2003/0186006 | A1 | 10/2003 | Schmidt et al. | |
| 2003/0196926 | A1 | 10/2003 | Tobias et al. | |
| 2003/0205550 | A1 | 11/2003 | Prevot et al. | |
| 2003/0217947 | A1 | 11/2003 | Ishikawa et al. | |
| 2004/0000533 | A1 | 1/2004 | Kamineni et al. | |
| 2004/0016716 | A1 | 1/2004 | Melrose et al. | |
| 2004/0074864 | A1 | 4/2004 | Melrose et al. | |
| 2004/0129669 | A1 | 7/2004 | Kelley et al. | |
| 2004/0149677 | A1 | 8/2004 | Slat et al. | |
| 2004/0173565 | A1 | 9/2004 | Semersky et al. | |
| 2004/0173656 | A1 | 9/2004 | Seong | |
| 2004/0211746 | A1 | 10/2004 | Trude | |
| 2004/0232103 | A1 | 11/2004 | Lisch et al. | |
| 2005/0211662 | A1 | 9/2005 | Eaton et al. | |
| 2005/0218108 | A1 | 10/2005 | Bangi et al. | |
| 2006/0006133 | A1 | 1/2006 | Lisch et al. | |
| 2006/0138074 | A1 | 6/2006 | Melrose | |
| 2006/0151425 | A1 | 7/2006 | Kelley et al. | |
| 2006/0231985 | A1 | 10/2006 | Kelley | |
| 2006/0243698 | A1 | 11/2006 | Melrose | |
| 2006/0255005 | A1 | 11/2006 | Melrose et al. | |
| 2006/0261031 | A1 | 11/2006 | Melrose | |
| 2007/0017892 | A1 | 1/2007 | Melrose | |
| 2007/0045222 | A1 | 3/2007 | Denner et al. | |
| 2007/0045312 | A1 | 3/2007 | Abercrombie, III et al. | |
| 2007/0051073 | A1 | 3/2007 | Kelley et al. | |
| 2007/0084821 | A1 | 4/2007 | Bysick et al. | |
| 2007/0125742 | A1 | 6/2007 | Simpson, Jr. et al. | |
| 2007/0125743 | A1 | 6/2007 | Pritchett et al. | |
| 2007/0131644 | A1 | 6/2007 | Melrose | |
| 2007/0181403 | A1 | 8/2007 | Sheets et al. | |
| 2007/0199915 | A1 | 8/2007 | Denner et al. | |
| 2007/0199916 | A1 | 8/2007 | Denner et al. | |
| 2007/0215571 | A1 | 9/2007 | Trude | |
| 2007/0235905 | A1 | 10/2007 | Trude et al. | |
| 2008/0047964 | A1 | 2/2008 | Denner et al. | |
| 2008/0156847 | A1 | 7/2008 | Hawk et al. | |
| 2008/0257856 | A1 | 10/2008 | Melrose et al. | |
| 2009/0126323 | A1 | 5/2009 | Kelley et al. | |
| 2009/0202766 | A1 | 8/2009 | Beuerle et al. | |
| 2009/0293436 | A1 | 12/2009 | Miyazaki et al. | |
| 2010/0018838 | A1 | 1/2010 | Kelley | |
| 2010/0116778 | A1 | 5/2010 | Melrose | |
| 2010/0163513 | A1 | 7/2010 | Pedmo | |
| 2010/0170199 | A1 | 7/2010 | Kelley et al. | |
| 2010/0213204 | A1 | 8/2010 | Melrose | |
| 2010/0237083 | A1 | 9/2010 | Trude et al. | |
| 2011/0049083 | A1 | 3/2011 | Scott et al. | |
| 2011/0094618 | A1 | 4/2011 | Melrose | |
| 2012/0292284 | A1 | 11/2012 | Melrose | |

FOREIGN PATENT DOCUMENTS

| | | | |
|---|---|---|---|
| DE | 1761753 | | 1/1972 |
| DE | 2102319 | | 8/1972 |
| DE | 3215866 | | 11/1993 |
| EP | 225 155 | A2 | 6/1987 |
| EP | 346518 | | 12/1989 |
| EP | 0502391 | A2 | 9/1992 |
| EP | 0505054 | A1 | 9/1992 |
| EP | 0521642 | | 1/1993 |
| EP | 0551788 | | 7/1993 |
| EP | 0666222 | | 8/1995 |
| EP | 0739703 | A1 | 10/1996 |
| EP | 0609348 | | 1/1997 |
| EP | 0916406 | | 5/1999 |
| EP | 0957030 | | 11/1999 |
| EP | 1063076 | | 12/2000 |
| EP | 1565381 | | 8/2005 |
| FR | 1571499 | | 6/1969 |
| FR | 2607109 | | 5/1988 |
| GB | 0781103 | | 8/1957 |
| GB | 1113988 | | 5/1968 |
| GB | 2050919 | | 1/1981 |
| GB | 2372977 | | 9/2002 |
| GE | 200677 | U | 8/2000 |
| JP | 48-31050 | | 9/1973 |
| JP | 49-28628 | | 7/1974 |
| JP | 54-72181 | | 6/1979 |
| JP | 56-056830 | A | 5/1981 |
| JP | 56-072730 | | 6/1981 |
| JP | 54-070185 | | 1/1982 |
| JP | 55-114717 | | 2/1982 |
| JP | 57-017730 | | 2/1982 |
| JP | 57-210829 | A | 2/1982 |
| JP | 57-126310 | U | 8/1982 |
| JP | 57-59447 | | 12/1982 |
| JP | 58-055005 | U | 4/1983 |
| JP | 61-192539 | A | 8/1986 |
| JP | 63-189224 | | 8/1988 |
| JP | 64-009146 | | 1/1989 |
| JP | 64-004662 | | 2/1989 |
| JP | 03-43342 | | 2/1991 |
| JP | 03-076625 | | 4/1991 |
| JP | 4-10012 | | 1/1992 |
| JP | 05-193694 | | 8/1992 |
| JP | 53-10239 | A | 11/1993 |
| JP | 06-270235 | A | 9/1994 |
| JP | 06-336238 | | 12/1994 |
| JP | 07-300121 | | 11/1995 |
| JP | 8-048322 | A | 2/1996 |
| JP | 8053115 | | 2/1996 |
| JP | 08-24474 | | 9/1996 |
| JP | 08-253220 | | 10/1996 |
| JP | 8282633 | A | 10/1996 |
| JP | 09-039934 | | 2/1997 |
| JP | 09-110045 | | 4/1997 |
| JP | 10-167226 | | 6/1998 |
| JP | 10-181734 | | 7/1998 |
| JP | 10-230919 | | 9/1998 |
| JP | 3056271 | | 11/1998 |
| JP | 11-218537 | A | 8/1999 |
| JP | 2000-168756 | | 6/2000 |
| JP | 2000-229615 | | 8/2000 |
| JP | 2002-127237 | | 5/2002 |
| JP | 2002-2160717 | A | 6/2002 |
| JP | 2002-326618 | A | 11/2002 |
| JP | 2003-095238 | A | 4/2003 |
| JP | 2004-026307 | A | 1/2004 |
| JP | 2006-501109 | | 1/2006 |
| JP | 2007-216981 | A | 8/2007 |
| JP | 2008-189721 | A | 8/2008 |
| JP | 2009001639 | A | 1/2009 |
| NZ | 240448 | | 6/1995 |
| NZ | 296014 | | 10/1998 |
| NZ | 335565 | | 10/1999 |
| NZ | 506684 | | 8/2000 |
| NZ | 512423 | | 6/2001 |
| NZ | 521694 | | 10/2003 |
| RU | 2021956 | | 10/1994 |

(56) References Cited

FOREIGN PATENT DOCUMENTS

| | | | |
|---|---|---|---|
| RU | 2096288 | | 11/1997 |
| WO | WO 93/09031 | | 5/1993 |
| WO | WO 93/12975 | | 7/1993 |
| WO | WO 94/05555 | | 3/1994 |
| WO | WO 94/06617 | | 3/1994 |
| WO | WO 97/03885 | | 2/1997 |
| WO | WO 97/03885 | A1 | 2/1997 |
| WO | WO 97/014617 | | 4/1997 |
| WO | WO 97/034808 | | 9/1997 |
| WO | WO 99/021770 | | 5/1999 |
| WO | WO 00/38902 | A1 | 7/2000 |
| WO | WO 00/51895 | | 9/2000 |
| WO | WO 01/12531 | A1 | 2/2001 |
| WO | WO 01/040081 | | 6/2001 |
| WO | WO 01/74689 | A1 | 10/2001 |
| WO | WO 02/02418 | | 1/2002 |
| WO | WO 02/18213 | | 3/2002 |
| WO | WO 02/085755 | | 10/2002 |
| WO | WO 2004/028910 | | 4/2004 |
| WO | WO 2004/106175 | | 12/2004 |
| WO | WO 2004/106176 | | 12/2004 |
| WO | WO 2005/012091 | | 2/2005 |
| WO | WO 2005/025999 | A1 | 3/2005 |
| WO | WO 2005/087628 | | 9/2005 |
| WO | WO 2006/113428 | | 10/2006 |
| WO | WO 2007/047574 | A1 | 4/2007 |
| WO | WO 2007/127337 | | 11/2007 |
| WO | WO 2010/058098 | A2 | 5/2010 |

OTHER PUBLICATIONS

Wittman-Regis, Agnes, WIPO International Preliminary Examination Report (1 pg.) and Wartenhorst, F., Written Opinion, ISA/EP (4 pp.) for PCT/US/2004/024581 dated Jan. 30, 2006.
Visentin, Mauro, Supplemental European Search Report for EP03748817, completed Jul. 9, 2007, 2 pp.
National Intellectual Property Center of Georgia "Sakpatenti", Search Report in Filing No. 8770/01, Application No. AP2003 008770, (English translation by Darakhvelidze, Liliana) dated Mar. 1, 2006, 2 pp.
Giacobetti, Adriano, International Preliminary Examination Report (3 pp.) with Annex (Amended Specification and Claims) (7 pp.) for PCT/NZ03/00220, IPEA/AU completed Jan. 11, 2005, 10 pp. total.
Wable, Jagdish, International Search Report for PCT/NZ01/000176 (WO 02/018213) dated Nov. 8, 2001, ISA/AU, 3 pp.
Giacobetti, Adriano, International Search Report for PCT/NZ03/00220, dated Nov. 27, 2003, ISA/AU, 3 pp.
Europe Office Action for European App. No. 07794381.9 dated Nov. 21, 2012, 3 pp.
Europe Office Action for European App. No. 07794381.9 dated Dec. 8, 2011, 5 pp.
U.S. Appl. No. 10/566,294, Kelley File History.
U.S. Appl. No. 10/529,198, Melrose File History.
U.S. Appl. No. 11/704,338, Denner File History.
U.S. Appl. No. 11/413,124, Melrose File History.
U.S. Appl. No. 11/704,368, Melrose File History.
U.S. Appl. No. 12/178,186, Kelley File History.
U.S. Appl. No. 12/325,452, Kelley File History.
U.S. Appl. No. 12/885,533, Melrose File History.
U.S. Appl. No. 13/775,995, Melrose File History.
U.S. Appl. No. 14/499,031, Melrose File History.
U.S. Appl. No. 12/349,268, Kelley File History.
U.S. Appl. No. 12/354,327, Kelley File History.
U.S. Appl. No. 12/651,461, Kelley File History.
U.S. Appl. No. 13/087,472, Kelley File History.
U.S. Appl. No. 13/442,846, Melrose File History.
U.S. Appl. No. 13/450,872, Kelley File History.
U.S. Appl. No. 14/142,882, Melrose File History.
U.S. Appl. No. 14/187,217, Melrose File History.
U.S. Appl. No. 14/187,227, Melrose File History.
U.S. Appl. No. 10/529,198, filed Dec. 15, 2005, US 2006-0138074, U.S. Pat. No. 8,152,010.
U.S. Appl. No. 10/566,294, filed Sep. 5, 2006, US 2007-0051073, U.S. Pat. No. 7,726,106.
U.S. Appl. No. 11/416,124, filed Apr. 28, 2006, US 2006-0255005, U.S. Pat. No. 8,381,940.
U.S. Appl. No. 11/704,338, filed Feb. 9, 2007, US 2007-0199915, U.S. Pat. No. 8,127,955.
U.S. Appl. No. 11/704,368, filed Feb. 9, 2007, US 2008-0047964, U.S. Pat. No. 8,584,879.
U.S. Appl. No. 12/178,186, filed Jul. 23, 2008, US 2010-0018838, U.S. Pat. No. 8,627,944.
U.S. Appl. No. 12/325,452, filed Dec. 1, 2008, US 2009-0126323, U.S. Pat. No. 7,735,304.
U.S. Appl. No. 12/349,268, filed Jan. 6, 2009, US 2010-0170199, U.S. Pat. No. 7,926,243.
U.S. Appl. No. 12/354,327, filed Jan. 15, 2009, US 2009-0120530, U.S. Pat. No. 9,090,363.
U.S. Appl. No. 12/651,461, filed Jan. 2, 2010, US 2010-0170200, U.S. Pat. No. 8,096,098.
U.S. Appl. No. 12/885,533, filed Sep. 19, 2010, US 2011-0210133, U.S. Pat. No. 8,720,163.
U.S. Appl. No. 13/087,472, filed Apr. 15, 2011, US 2011-0185677, U.S. Pat. No. 8,171,701.
U.S. Appl. No. 13/412,572, filed Mar. 5, 2012, US 2013-0043208, U.S. Pat. No. 9,145,223.
U.S. Appl. No. 13/442,846, filed Apr. 9, 2012, US 2013-0068779, U.S. Pat. No. 9,211,968.
U.S. Appl. No. 13/450,872, filed Apr. 19, 2012, US 2012-0240515, U.S. Pat. No. 8,429,880.
U.S. Appl. No. 13/775,995, filed Feb. 25, 2013, US 2014-0034599.
U.S. Appl. No. 14/083,066, filed Nov. 18, 2013, US 2014-0069937, U.S. Pat. No. 9,387,971.
U.S. Appl. No. 14/187,217, filed Feb. 21, 2014, US 2014-0166676, U.S. Pat. No. 9,264,018.
U.S. Appl. No. 14/187,227, filed Feb. 22, 2014, US 2014-0165504.
U.S. Appl. No. 14/499,031, filed Sep. 26, 2014, US 2015-0251796.
U.S. Appl. No. 14/687,867, filed Apr. 15, 2015, US 2016-0075496.
U.S. Appl. No. 14/968,781, filed Dec. 14, 2015.
File History, U.S. Appl. No. 07/150,228, filed Jan. 29, 1988, dated Nov. 6, 1990 now U.S. Pat. No. 4,836,398 to Leftault.

* cited by examiner

SYSTEMS FOR COMPENSATING FOR VACUUM PRESSURE CHANGES WITHIN A PLASTIC CONTAINER

CROSS-REFERENCE TO RELATED APPLICATIONS

The present application is a continuation of U.S. patent application Ser. No. 13/775,995, filed Feb. 25, 2013, which is a divisional of U.S. patent application Ser. No. 11/413,124, filed on Apr. 28, 2006, now U.S. Pat. No. 8,381,940 issued Feb. 26, 2013. U.S. patent application Ser. No. 11/413,124 is a continuation-in-part of U.S. patent application Ser. No. 10/529,198, filed on Dec. 15, 2005, now U.S. Pat. No. 8,152,010, issued Apr. 10, 2012, which is the U.S. National Phase of International Application No. PCT/NZ2003/000220, filed on Sep. 30, 2003, which claims priority of New Zealand Application No. 521694, filed on Sep. 30, 2002. U.S. patent application Ser. No. 11/413,124 is also a continuation-in-part of U.S. patent application Ser. No. 10/566,294, filed on Sep. 5, 2006, now U.S. Pat. No. 7,726,106, issued Jun. 1, 2010, which is the U.S. National Phase of International Application No. PCT/US2004/024581, filed on Jul. 30, 2004, which claims priority of U.S. Provisional Patent Application No. 60/551,771, filed Mar. 11, 2004, expired, and U.S. Provisional Patent Application No. 60/491,179, filed Jul. 30, 2003, expired. The entire contents of the aforementioned applications are incorporated herein by reference.

BACKGROUND OF THE INVENTION

Field of the Invention

The present invention relates generally to methods of compensating for vacuum pressure changes within plastic containers, and in particular embodiments to methods that result in plastic containers in which the contents are pressurized to reinforce the walls of the containers.

Related Art

In order to achieve the strength characteristics of a glass bottle, conventional lightweight plastic containers are typically provided with rib structures, recessed waists, or other structures that reinforce the sidewall of the container. While known reinforcing structures usually provide the necessary strength, they tend to clutter the sidewall of the container and detract from the desired smooth, sleek appearance of a glass container. In addition, the known reinforcing structures often limit the number of shapes and configurations that are available to bottle designers. Thus, there remains a need in the art for a relatively lightweight plastic container that has the strength characteristics of a glass container as well as the smooth, sleek appearance of a glass container, and offers increased design opportunities.

BRIEF SUMMARY OF THE INVENTION

In summary, the present invention is directed to a plastic container having a structure that reduces the internal volume of the container in order to create a positive pressure inside the container. The positive pressure inside the container serves to reinforce the container, thereby reducing the need for reinforcing structures such as ribs in the sidewall. This allows the plastic container to have the approximate strength characteristics of a glass container and at the same time maintain the smooth, sleek appearance of a glass container.

In one exemplary embodiment, the present invention provides a plastic container comprising an upper portion including a finish adapted to receive a closure, a lower portion including a base, a sidewall extending between the upper portion and the lower portion, wherein the upper portion, the lower portion, and the sidewall define an interior volume for storing liquid contents. A pressure panel is located on the container and is moveable between an initial position and an activated position, wherein the pressure panel is located in the initial position prior to filling the container and is moved to the activated position after filling and sealing the container. Moving the pressure panel from the initial position to the activated position reduces the internal volume of the container and creates a positive pressure inside the container. The positive pressure reinforces the sidewall.

According to another exemplary embodiment, the present invention provides a plastic container comprising an upper portion having a finish adapted to receive a closure, a lower portion including a base, and a sidewall extending between the upper portion and the lower portion, a substantial portion of the sidewall being free of structural reinforcement elements, and a pressure panel located on the container and moveable between an initial position and an activated position. After the container is filled and sealed, the sidewall is relatively flexible when the pressure panel is in the initial position, and the sidewall becomes relatively stiffer after the pressure panel is moved to the activated position.

According to yet another exemplary embodiment, the present invention provides a method of processing a container comprising providing a container comprising a sidewall and a pressure panel, the container defining an internal volume, filling the container with a liquid contents, capping the container to seal the liquid contents inside the container, and moving the pressure panel from an initial position to an activated position in which the pressure panel reduces the internal volume of the container, thereby creating a positive pressure inside the container that reinforces the sidewall.

Further objectives and advantages, as well as the structure and function of preferred embodiments, will become apparent from a consideration of the description, drawings, and examples.

BRIEF DESCRIPTION OF THE DRAWINGS

The foregoing and other features and advantages of the invention will be apparent from the following, more particular description of a preferred embodiment of the invention, as illustrated in the accompanying drawings wherein like reference numbers generally indicate identical, functionally similar, and/or structurally similar elements.

DETAILED DESCRIPTION OF THE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without departing from the spirit and scope of the invention. All references cited herein are incorporated by reference as if each had been individually incorporated.

The present invention relates to a plastic container having one or more structures that allow the internal volume of the container to be reduced after the container has been filled and sealed. Reducing the internal volume of the container may result in an increase in pressure inside the container, for example, by compressing the headspace of the filled container. The pressure increase inside the container can have the effect of strengthening the container, for example, increasing the container's top-load capacity or hoop strength. The pressure increase can also help ward off deformation of the container that may occur over time, for example, as the container loses pressure due to vapor loss. In addition, the reduction in internal volume can be adjusted to compensate for the internal vacuum that often develops in hot-filled containers as a result of the cooling of the liquid contents after filling and capping. As a result, plastic containers according to the present invention can be designed with relatively less structural reinforcing elements than prior art containers. For example, plastic containers according to the present invention may have fewer reinforcing elements in the sidewall as compared to prior art designs.

Figure 24:
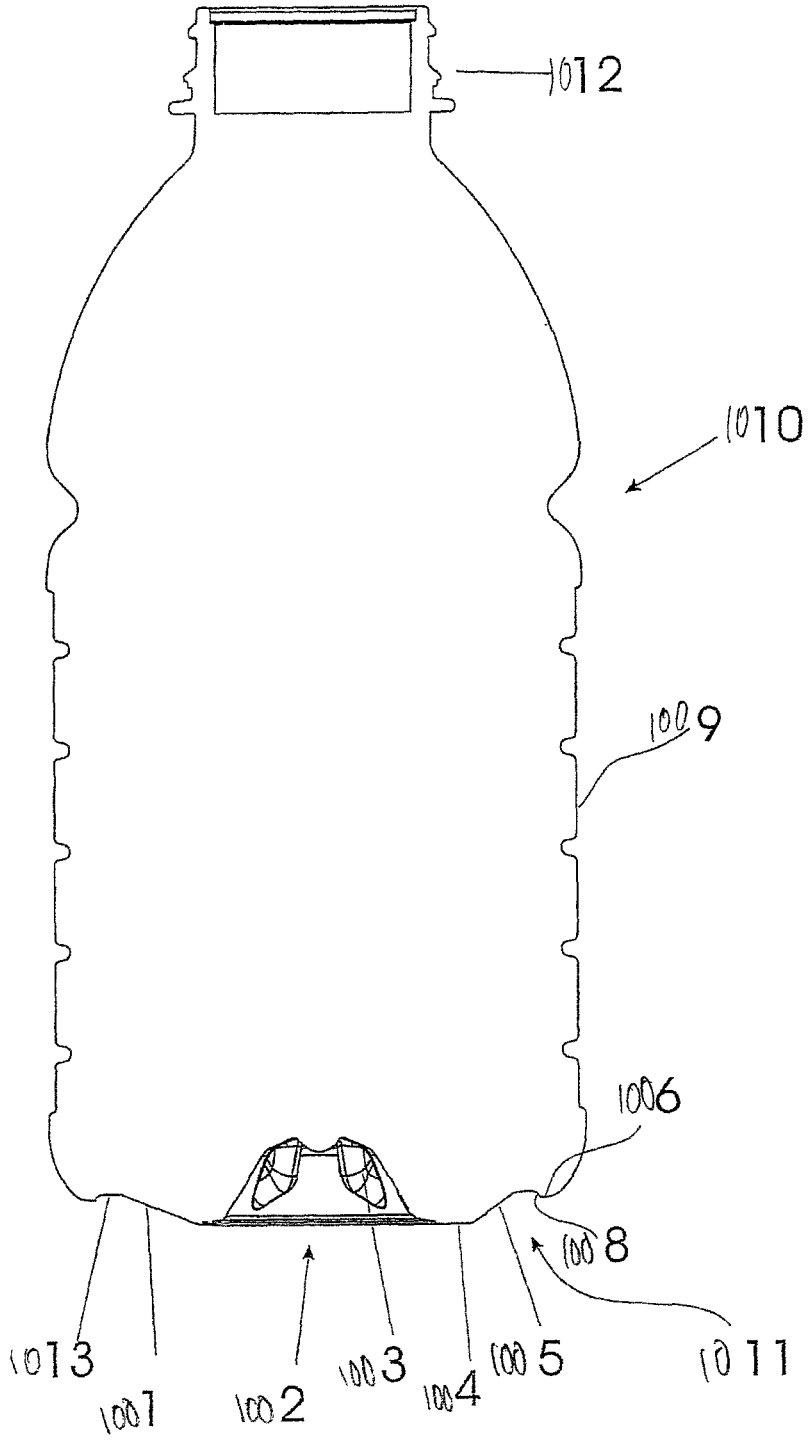
FIG. 24 is a cross-sectional view of a hot-fill container according to one possible embodiment of the invention in its pre-collapsed condition.

Referring to FIG. 24 which shows, by way of example only, and in a diagrammatic cross sectional view, a container in the form of a bottle. This is referenced generally by arrow 1010 with a typical neck portion 1012 and a side wall 1009 extending to a lower portion of the side wall 1011 and an underneath base portion 1002.

The container 1010 will typically be blow moulded from any suitable plastics material but typically this will be polyethylene terephthalate (PET).

The base 1002 is shown provided with a plurality of reinforcing ribs 1003 so as to form the typical "champagne" base although this is merely by way of example only.

In FIG. 24 the lower side wall portion 1011, which operates as a pressure panel, is shown in its unfolded position so that a ring or annular portion 1006 is positioned above the level of the bottom of the base 1002 which is forming the standing ring or support 1004 for the container 1010.

Figure 25:
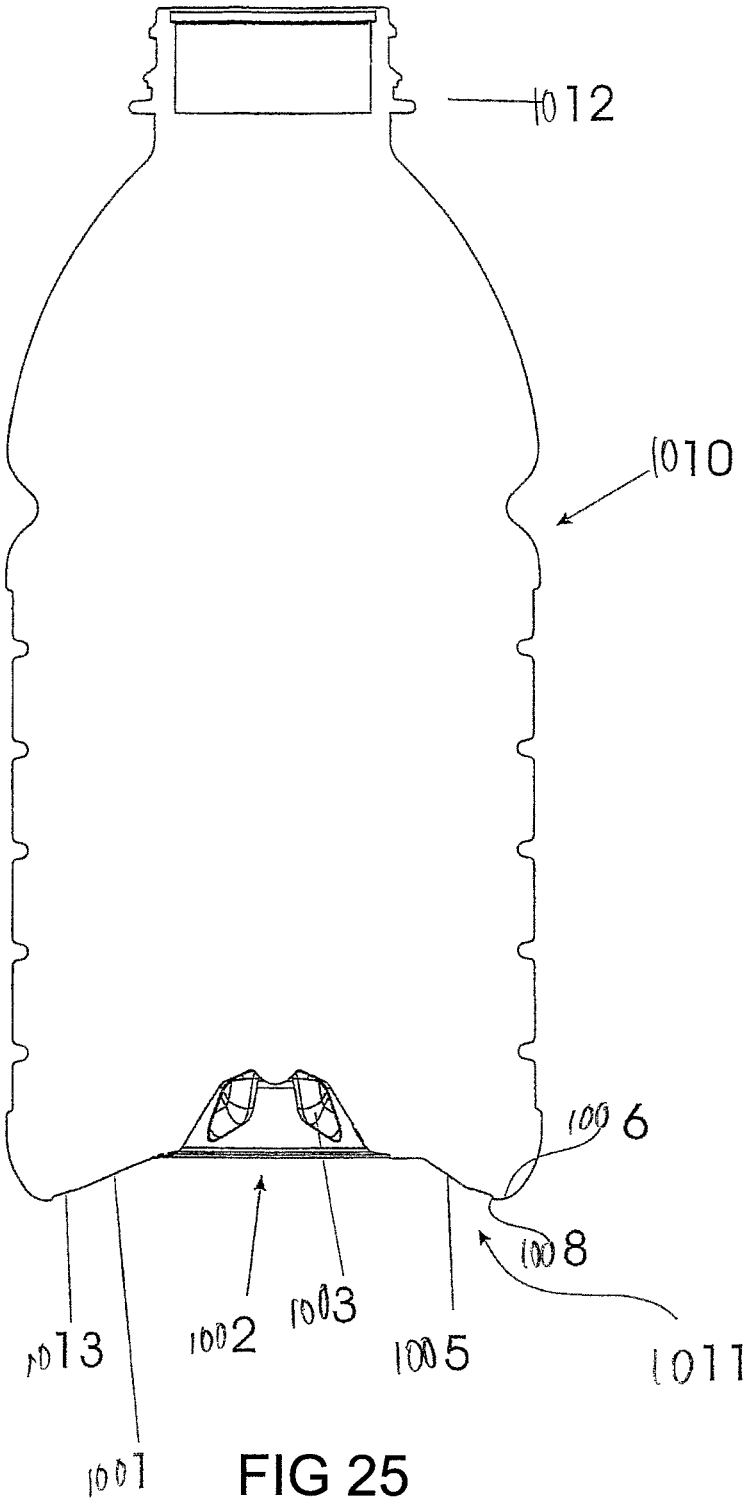
FIG. 25 shows the container of FIG. 24 in its collapsed position.

In FIG. 25 the lower side wall portion 1011 is shown having folded inwardly so that the ring or annular portion 1006 is positioned below the level of the bottom of the base 1002 and is forming the new standing ring or support for the container 1010.

Figure 26:
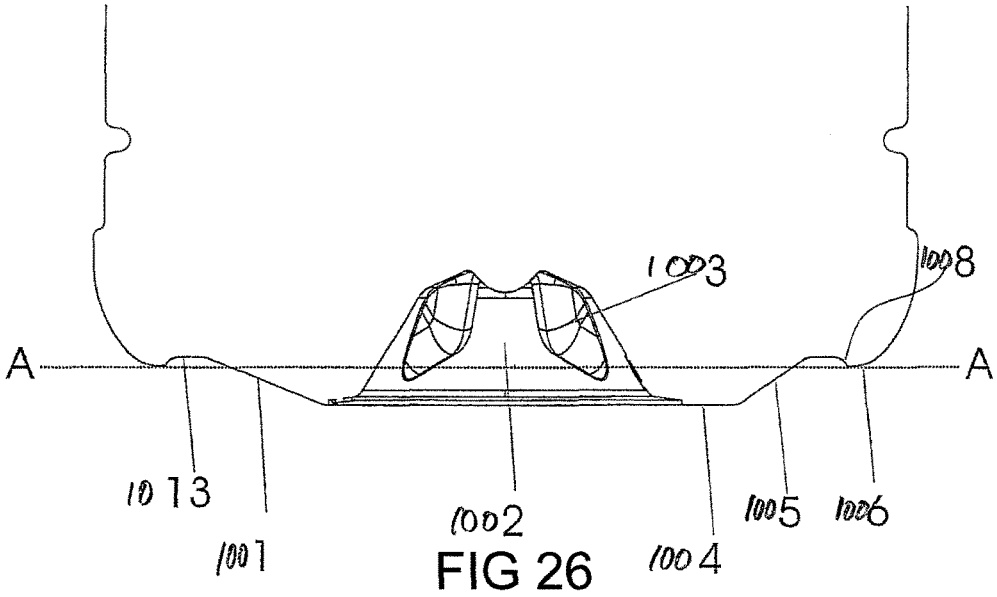
FIG. 26 shows the base of FIG. 24 before collapsing.
Figure 27:
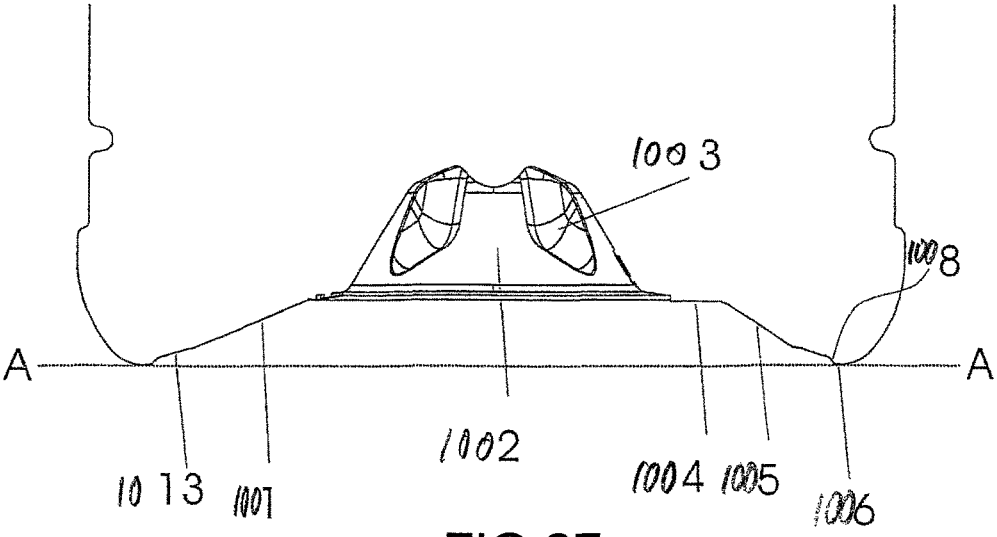
FIG. 27 shows the base of FIG. 25 following collapsing.

To assist this occurring, and as will be seen particularly in FIGS. 26 and 27, immediately adjacent the ring or annular portion 1006 there may be an instep or recess 1008 and decoupling structure 1013, in this case a substantially flat, non-ribbed region, which after folding enables the base portion 1002 to effectively completely disappear within the bottom of the container and above the line A-A. Many other configurations for the decoupling structure 1013 are envisioned, however.

Figure 28:
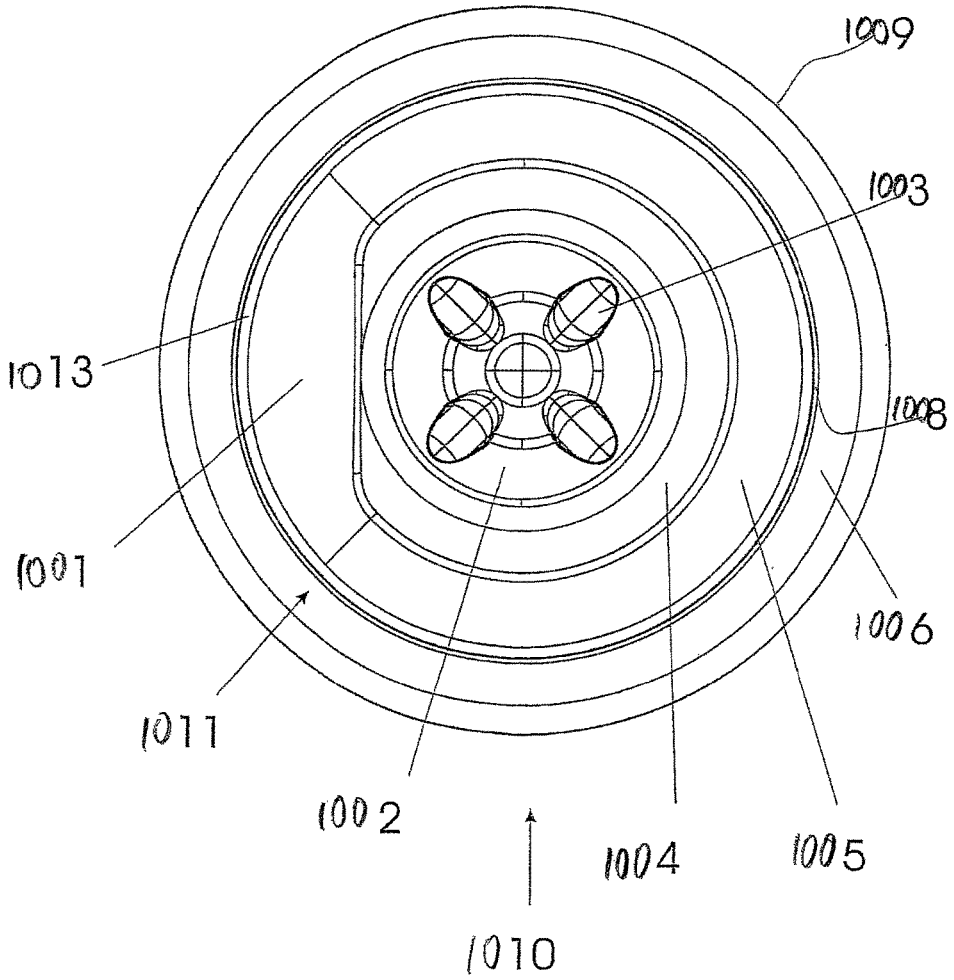
FIG. 28 shows an underneath view of the base of the container of FIG. 24 before collapsing.

Referring now particularly to FIG. 28, the base 1002 with its strengthening ribs 1003 is shown surrounded by the bottom annular portion 1011 of the side wall 1009 and the annular structure 1013. The bottom portion 1011 is shown in this particular embodiment as having an initiator portion 1001 which forms part of the collapsing or inverting section which yields to a longitudinally-directed collapsing force before the rest of the collapsing or folding section. The base 1002 is shown provided within the typical base standing ring 1004, which will be the first support position for the container 1010 prior to the inversion of the folding panel.

Associated with the initiator portion 1001 is a control portion 1005 which in this embodiment is a more steeply angled inverting section which will resist expanding from the collapsed state.

Forming the outer perimeter of the bottom portion 1011 of the side wall 1009 is shown the side wall standing ring or annular portion 1006 which following collapsing of the panel 1011 will provide the new container support.

Figure 29:
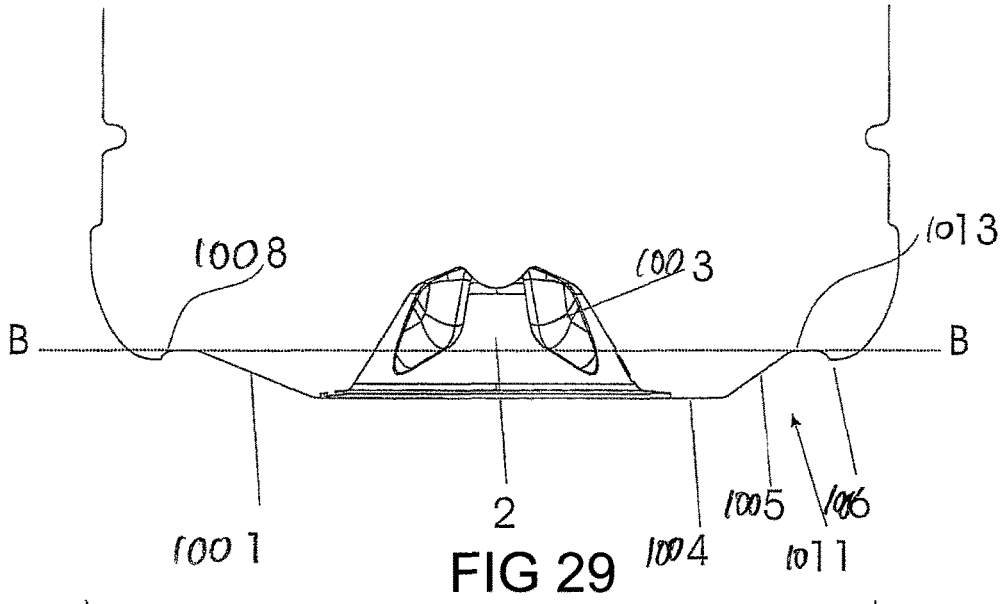
FIG. 29 shows the base of FIG. 24 before collapsing.

To allow for increased evacuation of vacuum it will be appreciated that it is preferable to provide a steep angle to the control portion 1005 of the pressure panel 1011. As shown in FIG. 29 the panel control portion 1005 is generally set with an angle varying between 30 degrees and 45 degrees. It is preferable to ensure an angle is set above 10 degrees at least. The initiator portion 1 may in this embodiment have a lesser angle of perhaps at least 10 degrees less than the control portion.

By way of example, it will be appreciated that when the panel 1011 is inverted by mechanical compression it will undergo an angular change that is double that provided to it. If the conical control portion 1005 is set to 10 degrees it will provide a panel change equivalent to 20 degrees. At such a low angle it has been found to provide an inadequate amount of vacuum compensation in a hot-filled container. Therefore it is preferable to provide much steeper angles.

Figure 30:
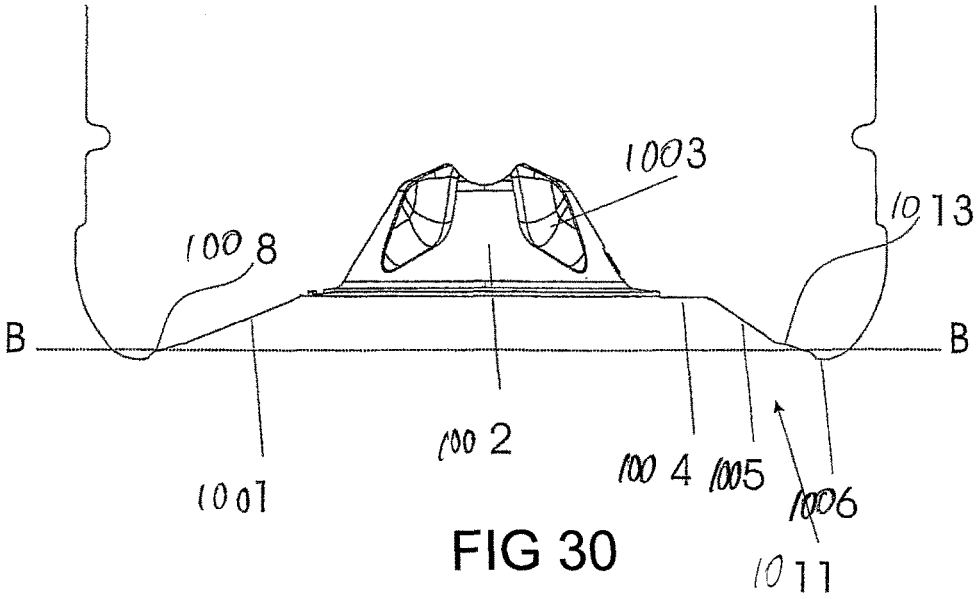
FIG. 30 shows the base of FIG. 25 following collapsing.

Referring to FIGS. 29 and 30, it will be appreciated that the control portion 1005 may be initially set to be outwardly inclined by approximately 35 degrees and will then provide an inversion and angle change of approximately 70 degrees. The initiator portion may in this example be 20 degrees.

Figure 31A:
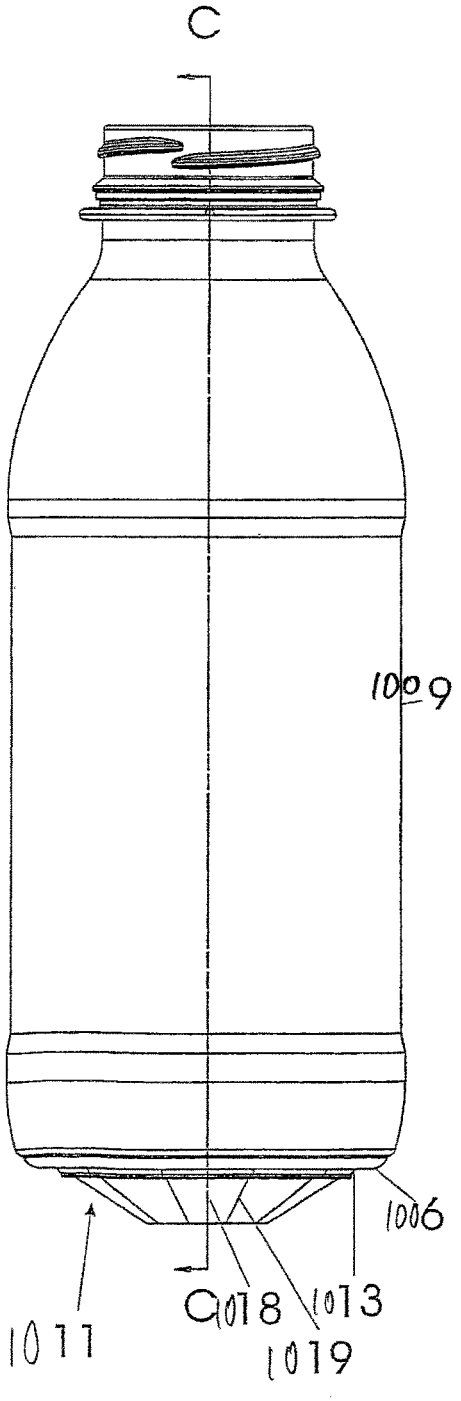
FIG. 31*a* is a side elevation view of a hot-fill container according to an alternative embodiment of the invention in its pre-collapsed condition.
Figure 31B:
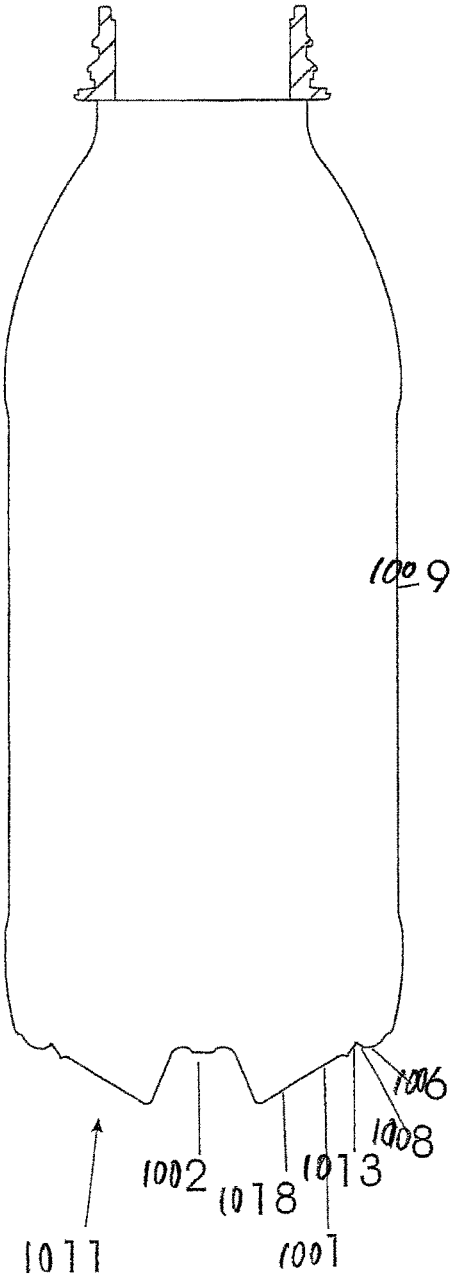
FIG. 31*b* is a cross-sectional view of the container shown in FIGS. 31*a* and 32 through line C-C.

Referring to FIGS. 31*a* and 31*b*, where the same reference numerals have been used where appropriate as previously, it is envisaged that in possible embodiments of this invention the initiator portion may be reconfigured so that control portion 1018 would provide essentially a continuous conical area about the base 1002.

The initiator portion 1001 and the control portion 1005 of the embodiment of the preceding figures will now be at a common angle, such that they form a uniformly inclined panel portion. However, initiator portion 1001 may still be configured to provide the area of least resistance to inversion, such that although it shares the same angular extent as the control portion 1018, it still provides an initial area of collapse or inversion. In this embodiment, initiator portion 1001 causes the pressure panel 1011 to begin inversion from the widest diameter adjacent the decoupling structure 1013.

Figure 32:
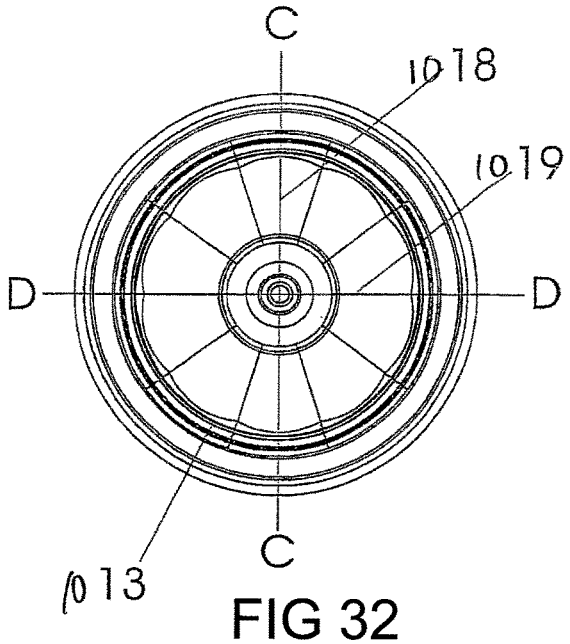
FIG. 32 is an underneath view of the base of the container of FIGS. 31*a* and 31*b* and FIG. 33 before collapsing.
Figure 33:
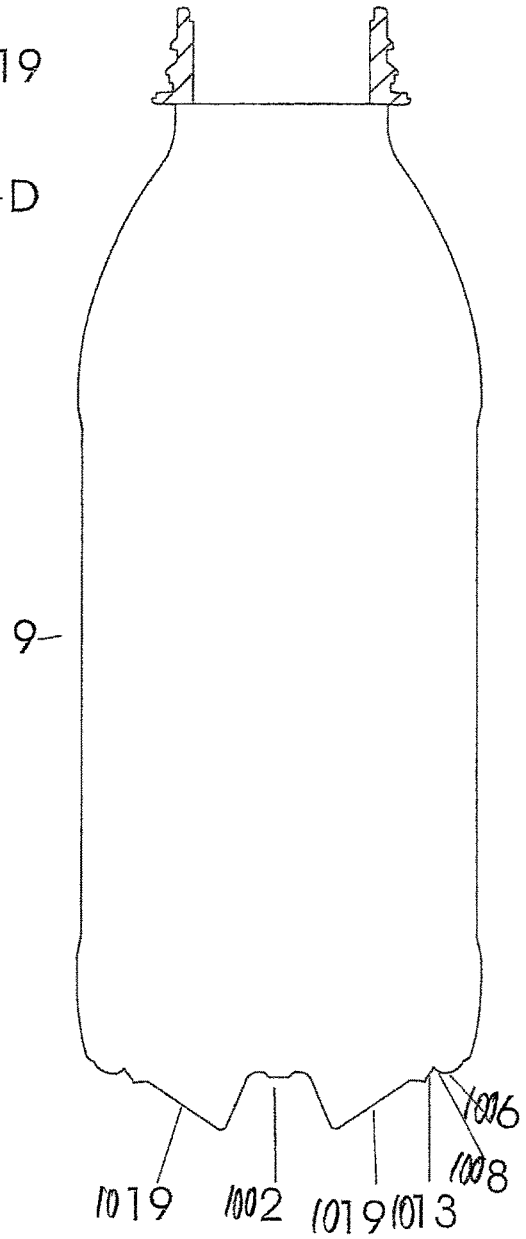
FIG. 33 is a cross-sectional view of the container shown in FIG. 32 through line D-D.

In this embodiment the container side walls 1009 are 'glass-like' in construction in that there are no additional strengthening ribs or panels as might be typically found on a container, particularly if required to withstand the forces of vacuum pressure. Additionally, however, structures may be added to the conical portions of the vacuum panel 1011 in order to add further control over the inversion process. For example, the conical portion of the vacuum panel 1011 may be divided into fluted regions. Referring to FIGS. 31*a* and 32 especially, panel portions that are convex outwardly, and evenly distributed around the central axis create regions of greater angular set 1019 and regions of lesser angular set 1018, may provide for greater control over inversion of the panel. Such geometry provides increased resistance to reversion of the panel, and a more even distribution of forces when in the inverted position.

Figures 34A, 34B, 34C, 34D:
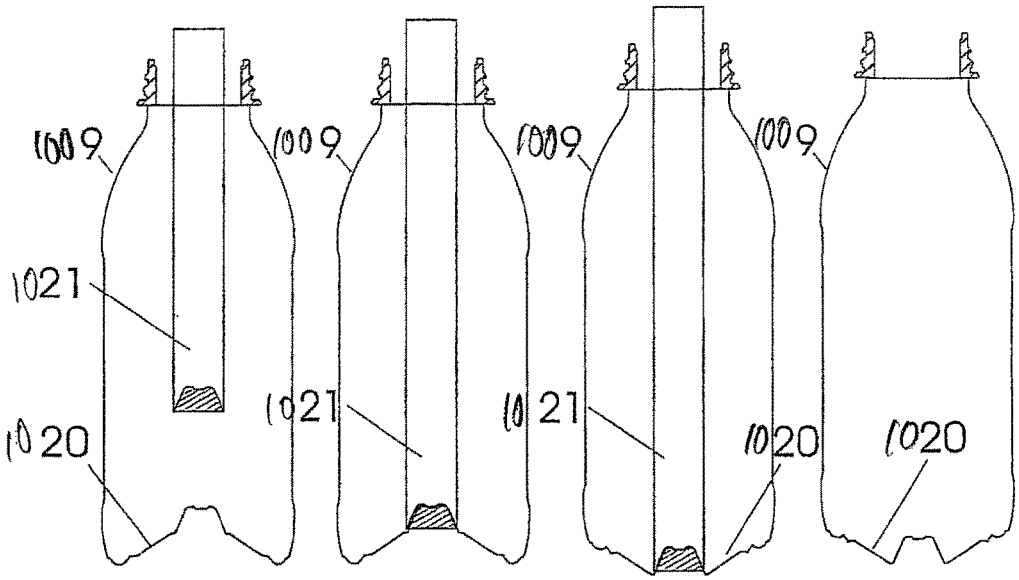
FIGS. 34*a-d* show cross-sectional views of the container according to an alternative embodiment of the invention incorporating a pusher to provide panel folding.
Figures 35A, 35B, 35C, 35D:
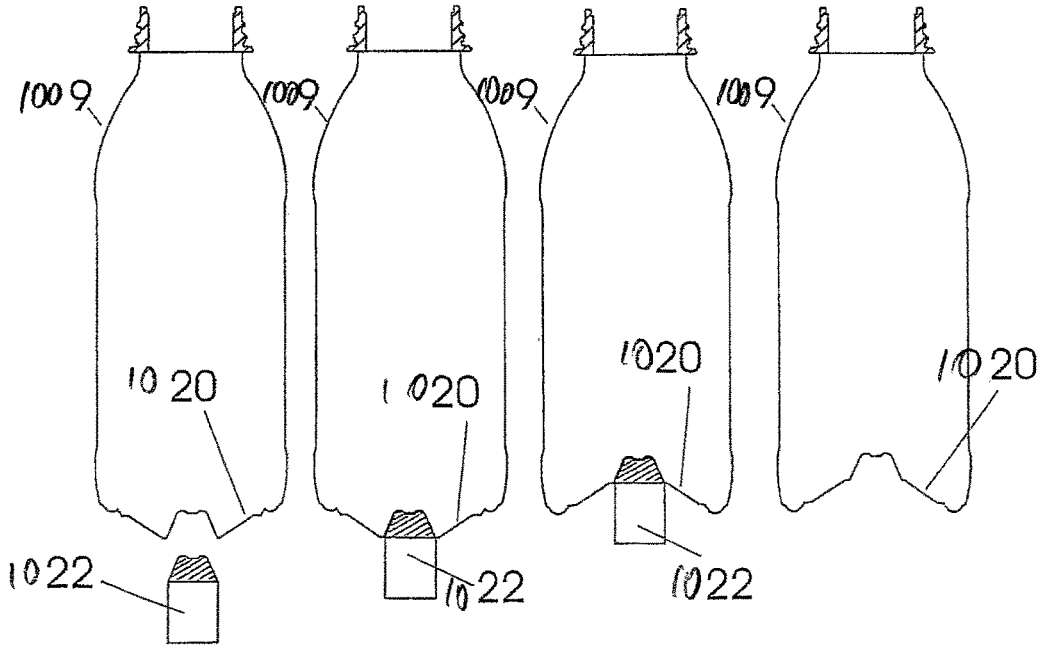
FIGS. 35*a-d* show cross-sectional views of the container according to a further alternative embodiment of the invention incorporating a pusher to provide panel folding.

In the embodiment as shown in FIGS. 34*a-d*, the container may be blow moulded with the pressure panel 1020 in the inwardly or upwardly inclined position. A force could be imposed on the folding panel 1020 such as by means of a mechanical pusher 1021 introduced through the neck region and forced downwardly in order to place the panel in the outwardly inclined position prior to use as a vacuum container for example, as shown in FIG. 34*d*.

In such an embodiment as shown in FIGS. 35*a-d*, following the filling and capping of the bottle and the use of cold water spray creating the vacuum within the filled bottle, a force could be imposed on the folding panel 1020 such as by means of a mechanical pusher 1022 or the creation of some relative movement of the bottle base relative to a punch or the like, in order to force the panel 1020 from an outwardly inclined position to an inwardly inclined position. Any deformation whereby the bottle shape was distorted prior to inversion of the panel 1020 would be removed as internal volume is forcibly reduced. The vacuum within the container is removed as the inversion of the panel 1020 causes a rise in pressure. Such a rise in pressure reduces vacuum pressure until ambient pressure is reached or even a slightly positive pressure is achieved.

It will be appreciated that in a further embodiment of the invention the panel may be inverted in the manner shown in FIGS. 35*a-d* in order to provide a panel to accommodate internal force such as is found in pasteurization and the like. In such a way the panel will provide relief against the internal pressure generated and then be capable of accommodating the resulting vacuum force generated when the product cools down.

In this way, the panel will be inverted from an upwardly inclined position FIGS. 34*a-b* to a downwardly inclined position as shown in FIGS. 34*c-d*, except that the mechanical action is not provided. The force is instead provided by the internal pressure of the contents.

Referring again to FIGS. 35*a-d* it will be seen that by the provision of the folding portion 1020 in the bottom of the side wall 1009 of the container 1010 the major portion of the side wall 1009 could be absent any structural features so that the container 1010 could essentially replicate a glass container if this was required.

Although particular structures for the bottom portion of the side wall 1009 are shown in the accompanying drawings it will be appreciated that alternative structures could be provided. For example a plurality of folding portions could be incorporated about the base 1002 in an alternative embodiment.

There may also be provided many different decoupling or hinge structures 1013 without departing from the scope of the invention. With particular reference to FIGS. 29 and 30, it can be seen that the side of the decoupling structure 1013 that is provided for the pressure panel 1011 may be of an enlarged area to provide for increased longitudinal movement upwards into the container following inversion.

Figure 36A:
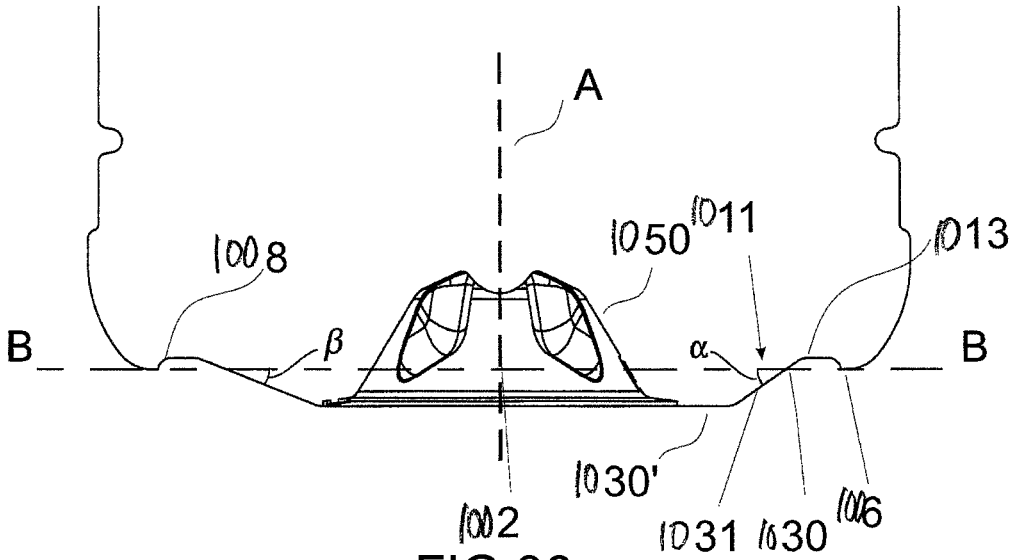
FIGS. 36*a-b* show the base of an alternative embodiment of the invention before collapsing.
Figure 37:
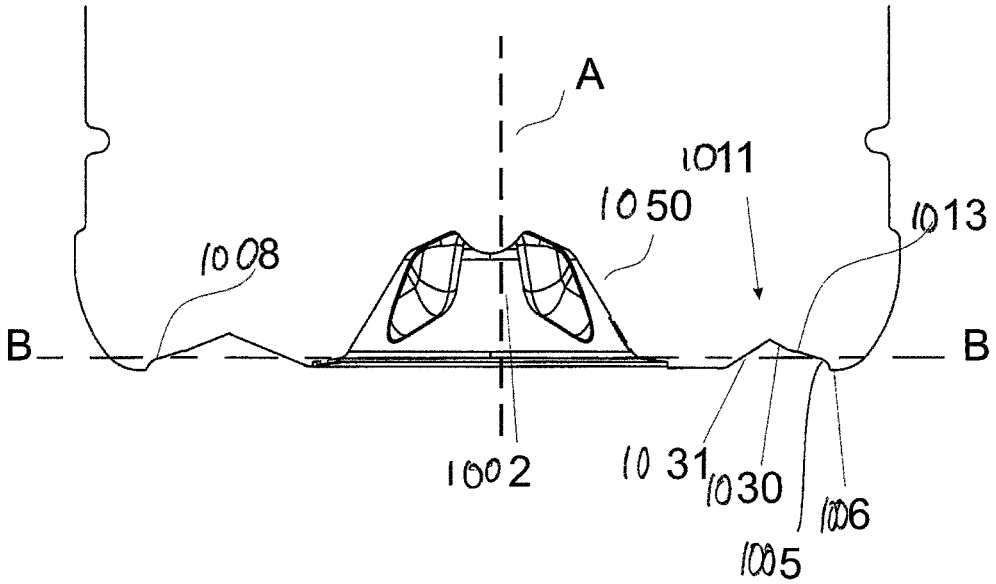
FIG. 37 shows the base of FIG. 36*a* during the initial stages of collapsing.

In a further embodiment of the present invention, and referring to FIGS. 36*a* and 37, it can be seen that the widest portions 1030 of the pressure panel 1011 may invert earlier than the narrower portions 1031. The initiator portion may be constructed with this in mind, to allow for thinner material and so on, to provide for the panel 1011 to begin inverting where it has the greater diameter, ahead of the narrower sections of the panel. In this case the portion 1030 of the panel, which is radially set more distant from the central axis of the container inverts ahead of portion 1031 to act as the initiator portion.

Figure 36B:
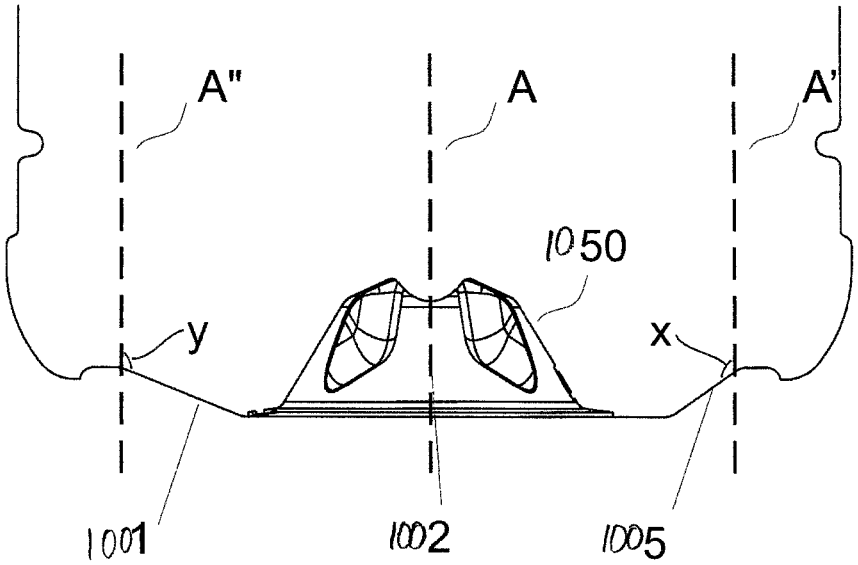

For reference, the angles of inclination of the initiator portion and control portion are shown in FIG. 36*a* marked as β and α, respectively, with reference to a plane orthogonal to the longitudinal axis. In FIG. 36*b*, angles β and α are instead defined with reference to the longitudinal axis and denoted y and x, respectively. As will be appreciated, if β is 10°, this may equate toy being 100°.

Figure 13A:
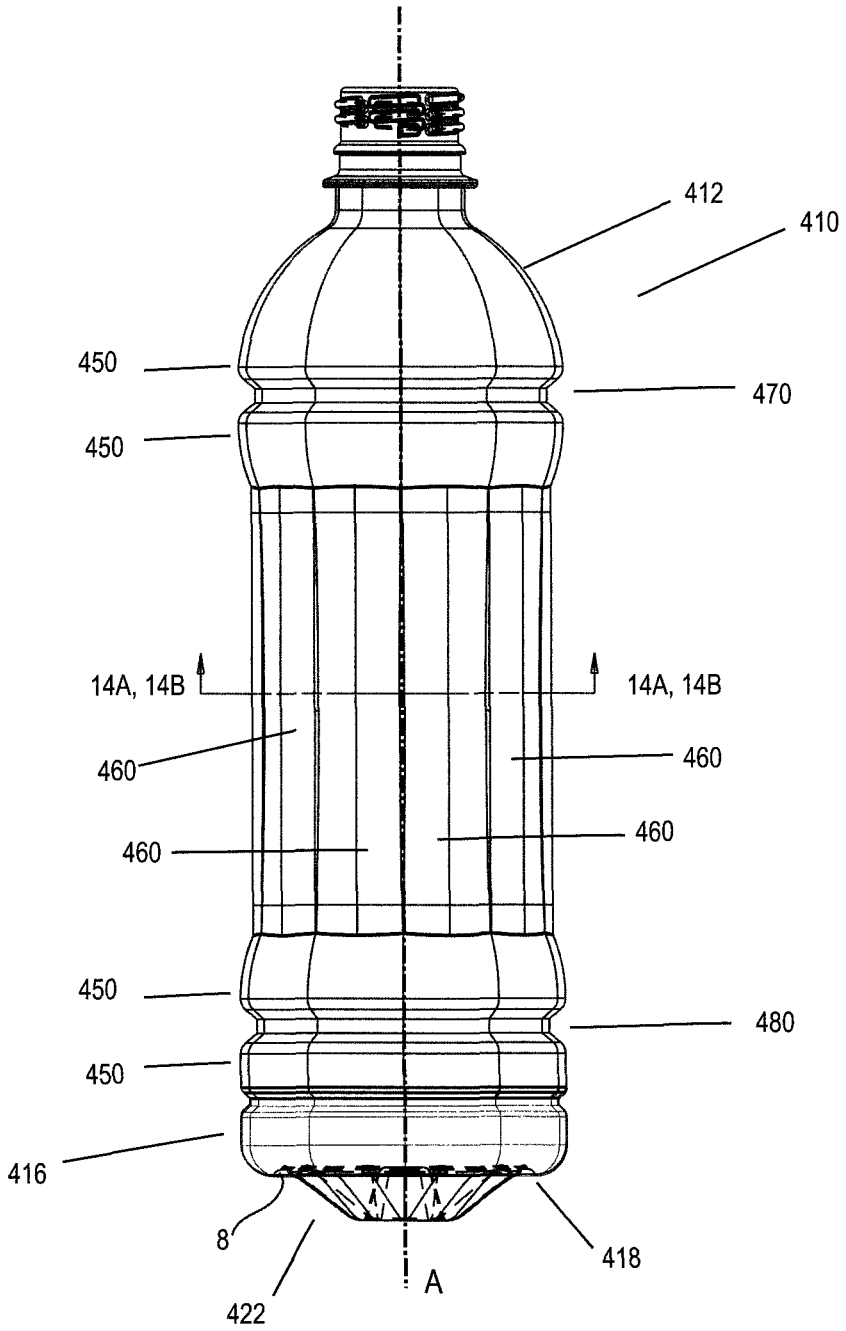
FIG. 13A is a side view of yet another alternative embodiment of a plastic container according to the present invention.
Figure 13B:
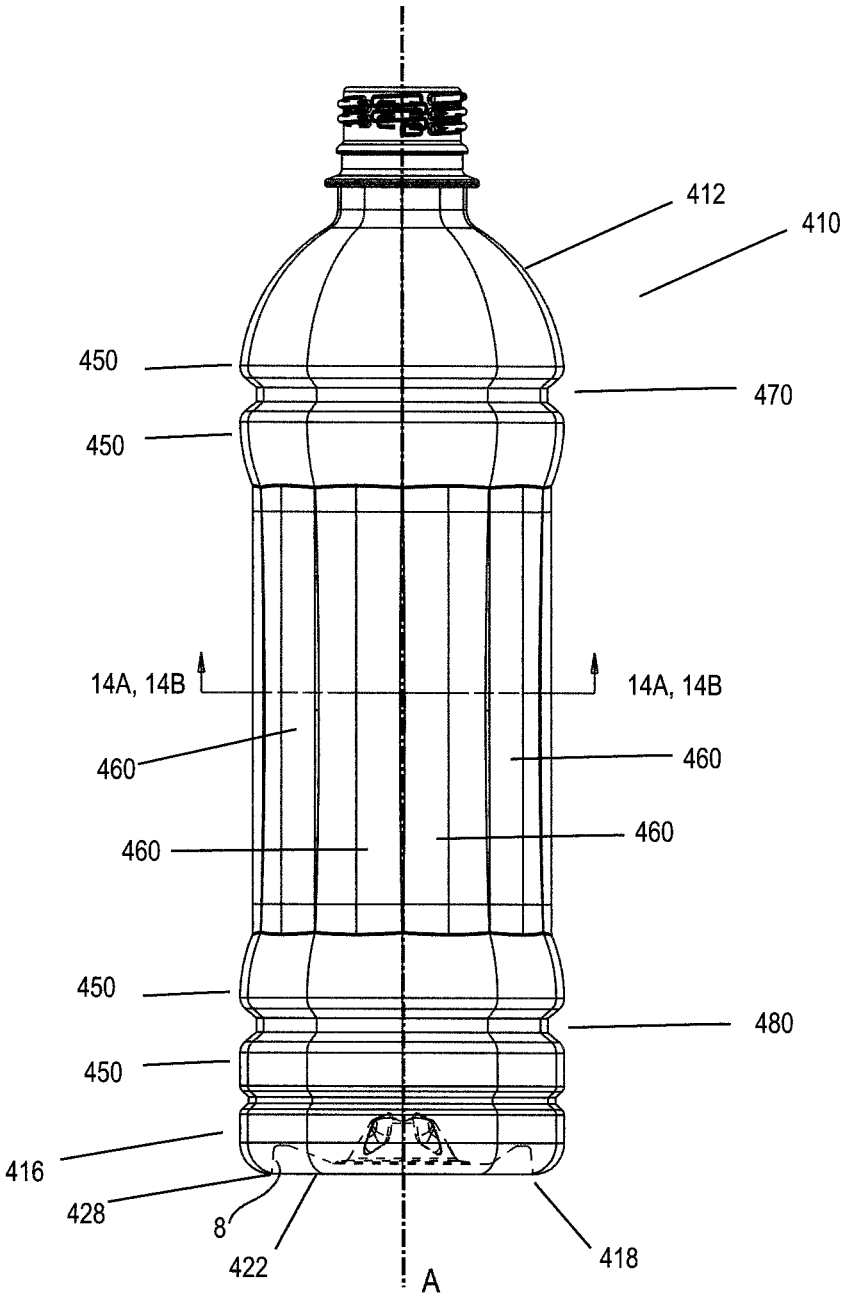
FIGS. 13B-C show views of containers according to further embodiments of the invention.
Figure 13C:
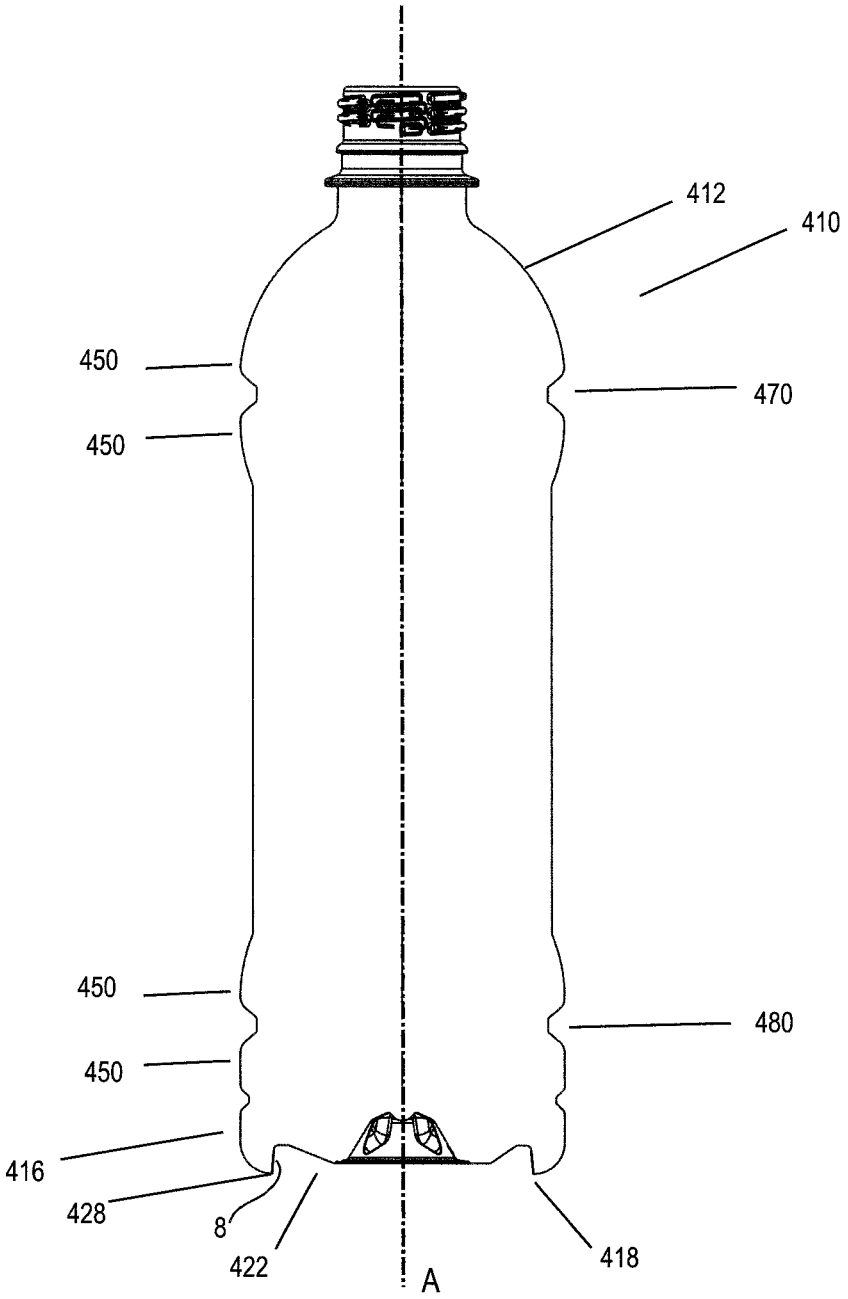
Figure 38:
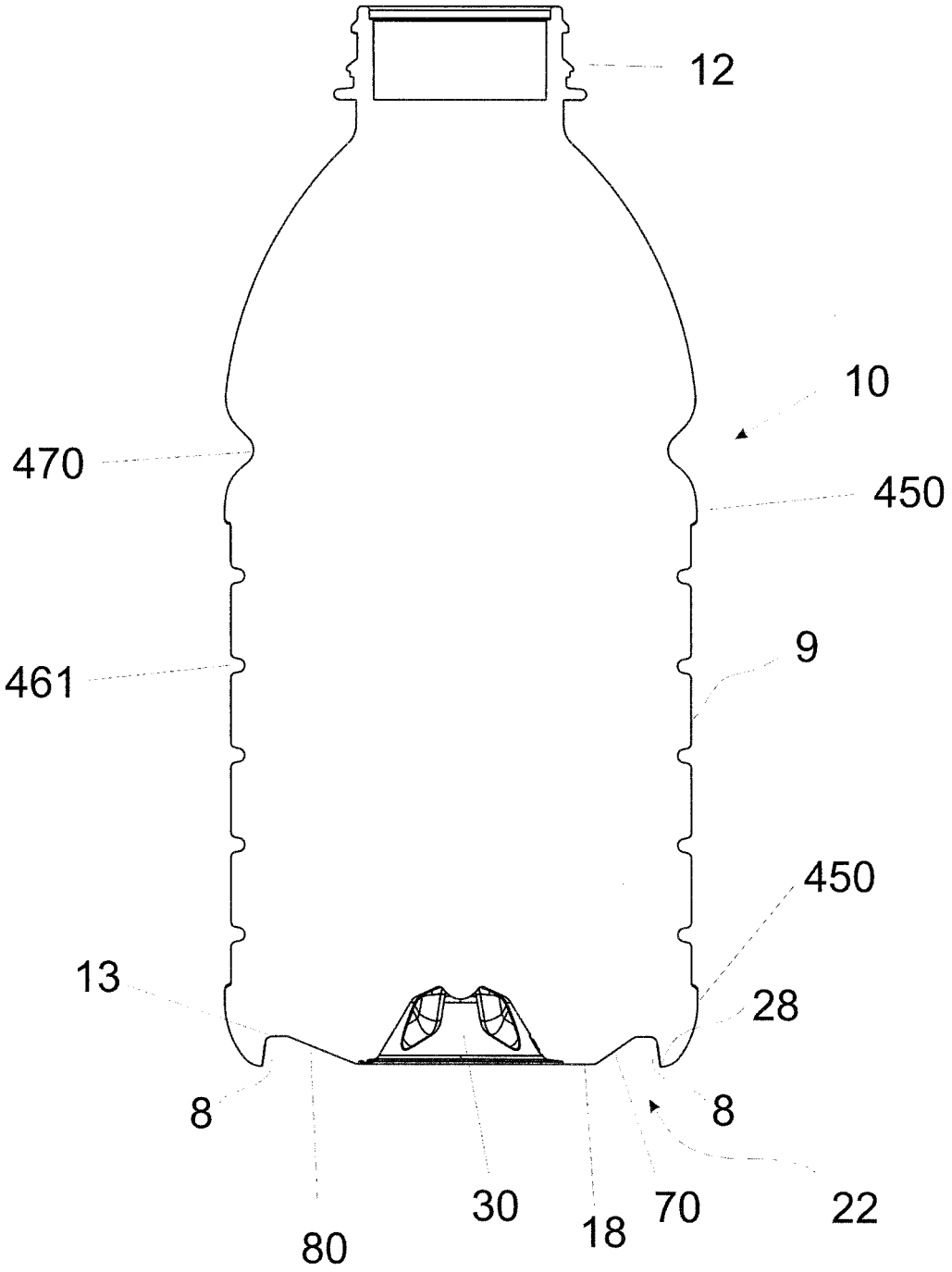
FIG. 38 shows a view of a container according to a further embodiment of the invention.

The container of FIGS. 36A-37 include an instep or recess 1008. As a further example, as shown in FIG. 38, the instep 8 may be recessed to such an extent that the entire lower sidewall portion and base are substantially or completely contained above the standing ring 28 even prior to folding of the pressure panel 22. Preferably the pressure panel 22 includes a portion inclined outwardly at an angle of greater than 10 degrees relative to a plane orthogonal to a longitudinal axis of the container when the pressure panel is in the initial position. FIGS. 13B and 13C show the container of FIG. 13A modified in a similar manner.

Referring to FIGS. 1-4, an exemplary container embodying the principles of the present invention is shown. Container 10 generally includes an upper portion 12 including a finish 14 adapted to receive a closure, such as a cap or a spout. Container 10 also includes a lower portion 16 including a base 18, which may be adapted to support container 10, for example, in an upright position on a generally smooth surface. A sidewall 20 extends between the upper portion 12 and the lower portion 16. The upper portion 12, lower portion 16, and sidewall 20 generally define an interior volume of container 10, which can store liquid contents, such as juices or other beverages. According to one exemplary embodiment of the invention, the liquid contents can be hot filled, as will be described in more detail below. Container 10 is typically blow molded from a plastic material, such as a thermoplastic polyester resin, for example, PET (polyethylene terephthalate), or polyolefins, such as PP and PE, although other materials and methods of manufacture are possible.

Figure 1:
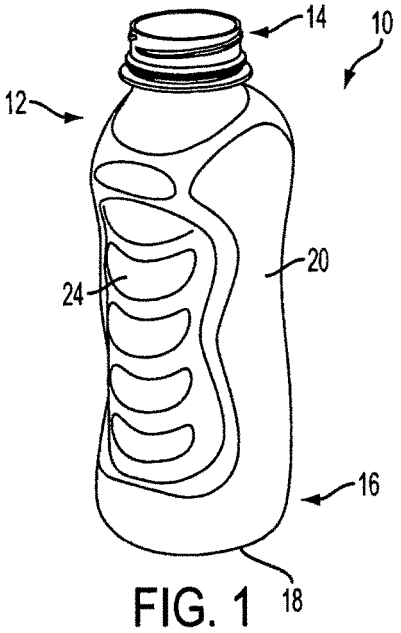
FIG. 1 is a perspective view of an exemplary embodiment of a plastic container according to the present invention.
Figure 2:
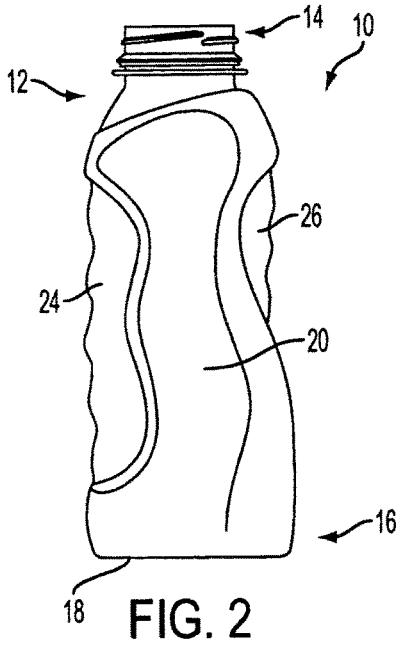
FIG. 2 is a side view of the plastic container of FIG. 1.
Figure 3:
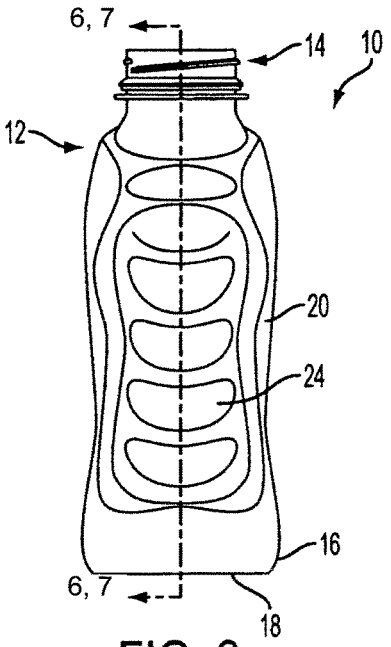
FIG. 3 is a front view of the plastic container of FIG. 1.
Figure 4:
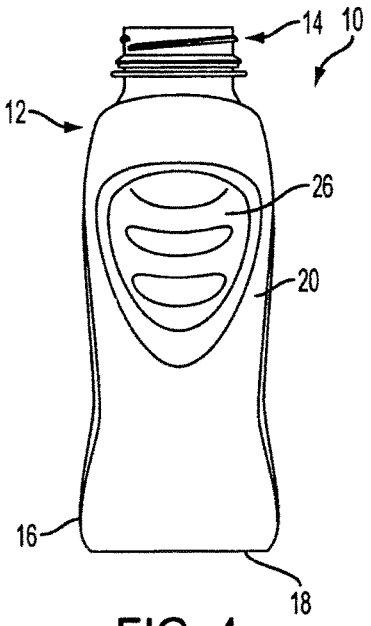
FIG. 4 is a rear view of the plastic container of FIG. 1.
Figure 5:
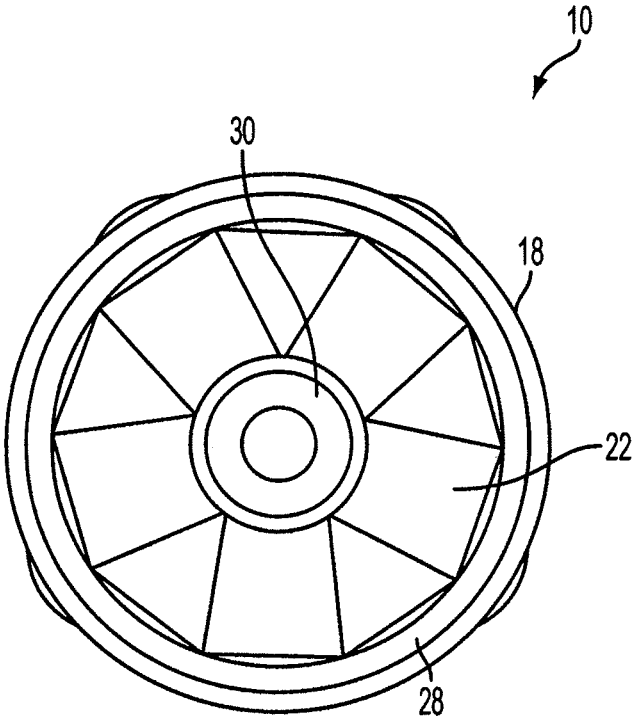
FIG. 5 is a bottom view of the plastic container of FIG. 1.

Referring to FIG. 5, base 18, or some other portion of container 10, can include a pressure panel 22. Pressure panel 22 can be activated to reduce the internal volume of the container 10 once it is filled and sealed, thereby creating a positive pressure inside container 10. For example, activating pressure panel 22 can serve to compress the headspace of the container (i.e., the portion of the container that is not occupied by liquid contents). Based on the configuration of the pressure panel 22, the shape of container 10, and/or the thickness of sidewall 20, the positive pressure inside container 10 can be sufficiently large to reinforce container 10, and more specifically, sidewall 20. As a result, and as shown in FIGS. 1-4, sidewall 20 can remain relatively thin and still have at least a substantial portion that is free of known structural reinforcement elements (such as ribs) that were previously considered necessary to strengthen containers, and which can detract from the sleek appearance of containers.

Referring to FIGS. 1-4, sidewall 20 can have a generally circular cross-section, although other known cross-sections are possible. The portions of the sidewall 20 that are free of structural reinforcement elements may have ornamental features, such as dimples, textures, or etchings. Additionally or alternatively, sidewall 20 can include one or more grip panels, for example, first grip panel 24 and second grip panel 26. It is known in the prior art for grip panels to serve as reinforcement elements, however, this may not be necessary with grip panels 24, 26 if the pressure panel 22 is configured to provide sufficient pressure inside container 10. Accordingly, simplified grip panels (e.g., without stiff rib structures) may be provided that do not serve as reinforcement elements, or that do so to a lesser extent than with prior art containers.

Figure 6:
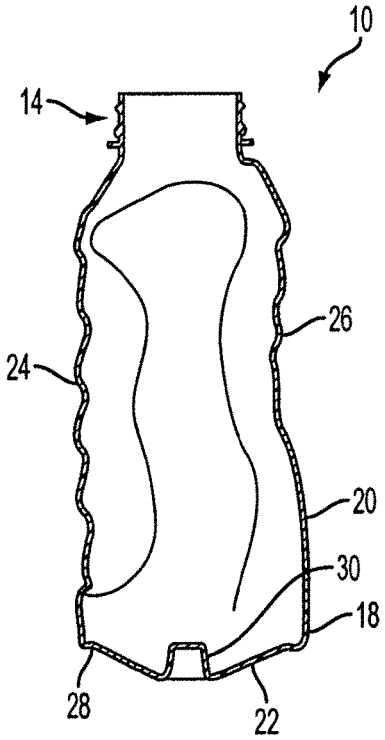
FIG. 6 is a cross-sectional view of the plastic container of FIG. 1 taken along line 6, 7 of FIG. 3, shown with a pressure panel in an initial position.
Figure 7:
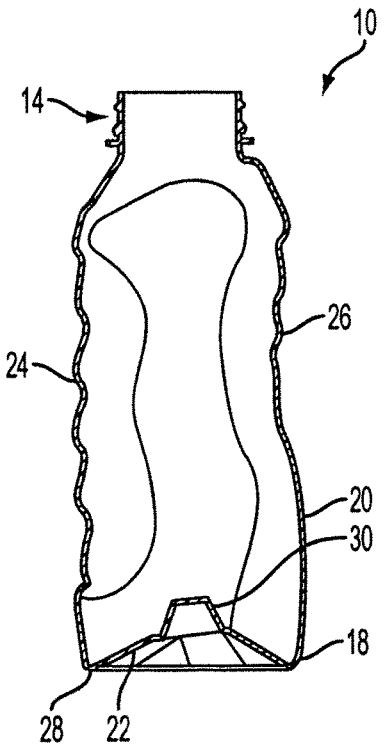
FIG. 7 is a cross-sectional view of the plastic container of FIG. 1 taken along line 6, 7 of FIG. 3, shown with the pressure panel in an activated position.

Referring to FIGS. 5-7, base 18 can include a standing ring 28. Pressure panel 22 can be in the form of an invertible panel that extends from the standing ring 28 to the approximate center of the base 18. In the exemplary embodiment shown, pressure panel 22 is faceted and includes a push-up 30 proximate its center, although other configurations of pressure panel 22 are possible. Standing ring 28 can be used to support container 10, for example on a relatively flat surface, after the pressure panel 22 is activated.

Pressure panel 22 can be activated by moving it from an initial position (shown in FIG. 6) in which the pressure panel 22 extends outward from container 10, to an activated position (shown in FIG. 7) in which the pressure panel 22 extends inward into the interior volume of the container 10. In the exemplary embodiment shown in FIGS. 5-7, moving pressure panel 22 from the initial position to the activated position effectively reduces the internal volume of container 10. This movement can be performed by an external force applied to container 10, for example, by pneumatic or mechanical means.

Container 10 can be filled with the pressure panel 22 in the initial position, and then the pressure panel 22 can be moved to the activated position after container 10 is filled and sealed, causing a reduction in internal volume in container 10. This reduction in the internal volume can create a positive pressure inside container 10. For example, the reduction in internal volume can compress the headspace in the container, which in turn will exert pressure back on the liquid contents and the container walls. It has been found that this positive pressure reinforces container 10, and in particular, stiffens sidewall 20 as compared to before the pressure panel 22 is activated. Thus, the positive pressure created as a result of pressure panel 22 allows plastic container 10 to have a relatively thin sidewall yet have substantial portions that are free of structural reinforcements as compared to prior art containers. One of ordinary skill in the art will appreciate that pressure panel 22 may be located on other areas of container 10 besides base 18, such as sidewall 20. In addition, one of ordinary skill in the art will appreciate that the container can have more than one pressure panel 22, for example, in instances where the container is large and/or where a relatively large positive pressure is required inside the container.

The size and shape of pressure panel 22 can depend on several factors. For example, it may be determined for a specific container that a certain level of positive pressure is required to provide the desired strength characteristics (e.g., hoop strength and top load capacity). The pressure panel 22 can thus be shaped and configured to reduce the internal volume of the container 10 by an amount that creates the predetermined pressure level. For containers that are filled at ambient temperature, the predetermined amount of pressure (and/or the amount of volume reduction by pressure panel 22) can depend at least on the strength/flexibility of the sidewall, the shape and/or size of the container, the density of the liquid contents, the expected shelf life of the container, and/or the amount of headspace in the container. Another factor to consider may be the amount of pressure loss inside the container that results from vapor loss during storage of the container. Yet another factor may be volume reduction of the liquid contents due to refrigeration during storage. For containers that are "hot filled" (i.e., filled at an elevated temperature), additional factors may need to be considered to compensate for the reduction in volume of the liquid contents that often occurs when the contents cool to ambient temperature (and the accompanying vacuum that may form in the container). These additional factors can include at least the coefficient of thermal expansion of the liquid contents, the magnitude of the temperature changes that the contents undergo, and/or water vapor transmission. By considering all or some of the above factors, the size and shape of pressure panel 22 can be calculated to achieve predictable and repeatable results. It should be noted that the positive pressure inside the container 10 is not a temporary condition, but rather, should last for at least 60 days after the pressure panel is activated, and preferably, until the container 10 is opened.

Figure 8C:
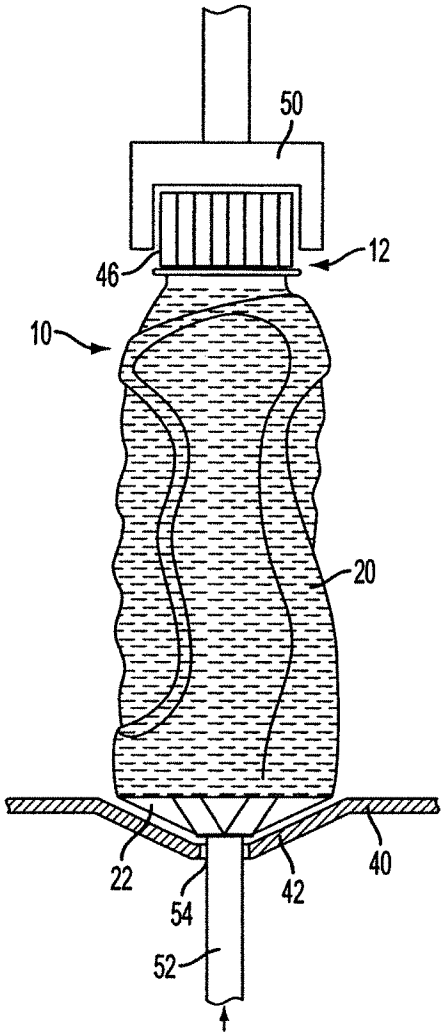
FIGS. 8A-8C schematically represent the steps of an exemplary method of processing a container according to the present invention.
Figure 8B:
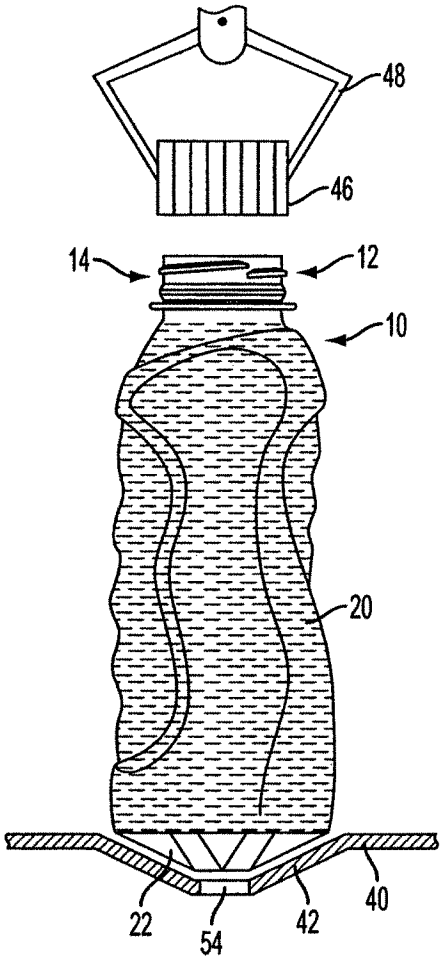
Figure 8A:
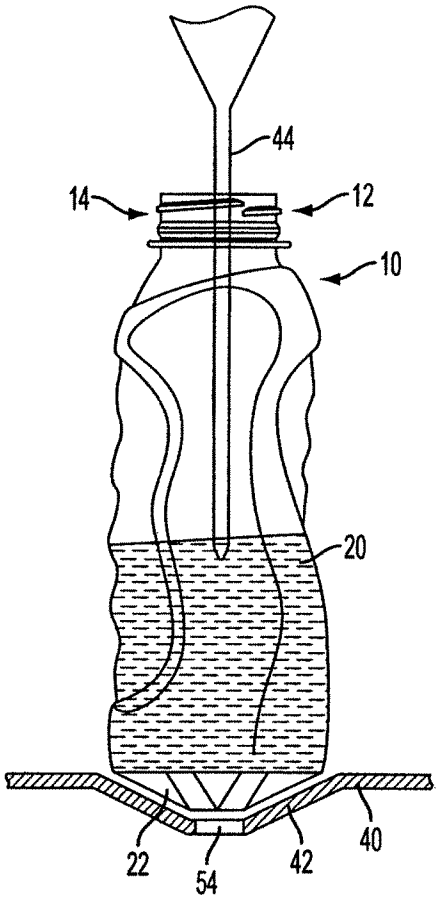

Referring to FIGS. 8A-8C, an exemplary method of processing a container according to the present invention is shown. The method can include providing a container 10 (such as described above) having the pressure panel 22 in the initial position, as shown in FIG. 8A. The container 10 can be provided, for example, on an automated conveyor 40 having a depressed region 42 configured to support container 10 when the pressure panel 22 is in the initial, outward position. A dispenser 44 is inserted into the opening in the upper portion 12 of the container 10, and fills the container 10 with liquid contents. For certain liquid contents (e.g., juices), it may be desirable to fill the container 10 with the contents at an elevated temperature (i.e., above ambient temperature). Once the liquid contents reach a desired fill level inside container 10, the dispenser 44 is turned off and removed from container 10. As shown in FIG. 8B, a closure, such as a cap 46, can then be attached to the container's finish 14, for example, by moving the cap 46 into position and screwing it onto the finish 14 with a robotic arm 48. One of ordinary skill in the art will appreciate that various other techniques for filling and sealing the container 10 can alternatively be used.

Once the container 10 is filled and sealed, the pressure panel 22 can be activated by moving it to the activated position. For example, as shown in FIG. 8C, a cover 50, arm, or other stationary object may contact cap 46 or other portion of container 10 to immobilize container 10 in the vertical direction. An activation rod 52 can engage pressure panel 22, preferably proximate the push-up 30 (shown in FIG. 7) and move the pressure panel 22 to the activated position (shown in FIG. 7). The displacement of pressure panel 22 by activation rod 52 can be controlled to provide a predetermined amount of positive pressure, which, as discussed above, can depend on various factors such as the strength/flexibility of the sidewall 20, the shape and/or size of the container, etc.

In the exemplary embodiment shown in FIG. 8C, the activation rod 52 extends through an aperture 54 in conveyor 40, although other configurations are possible. In the case where the liquid contents are filled at an elevated temperature, the step of moving the pressure panel 22 to the inverted position can occur after the liquid contents have cooled to room temperature.

As discussed above, moving the pressure panel 22 to the activated position reduces the internal volume of container 10 and creates a positive pressure therein that reinforces the sidewall 20. As also discussed above, the positive pressure inside container 10 can permit at least a substantial portion of sidewall 20 to be free of structural reinforcements, as compared to prior art containers.

Figure 9:
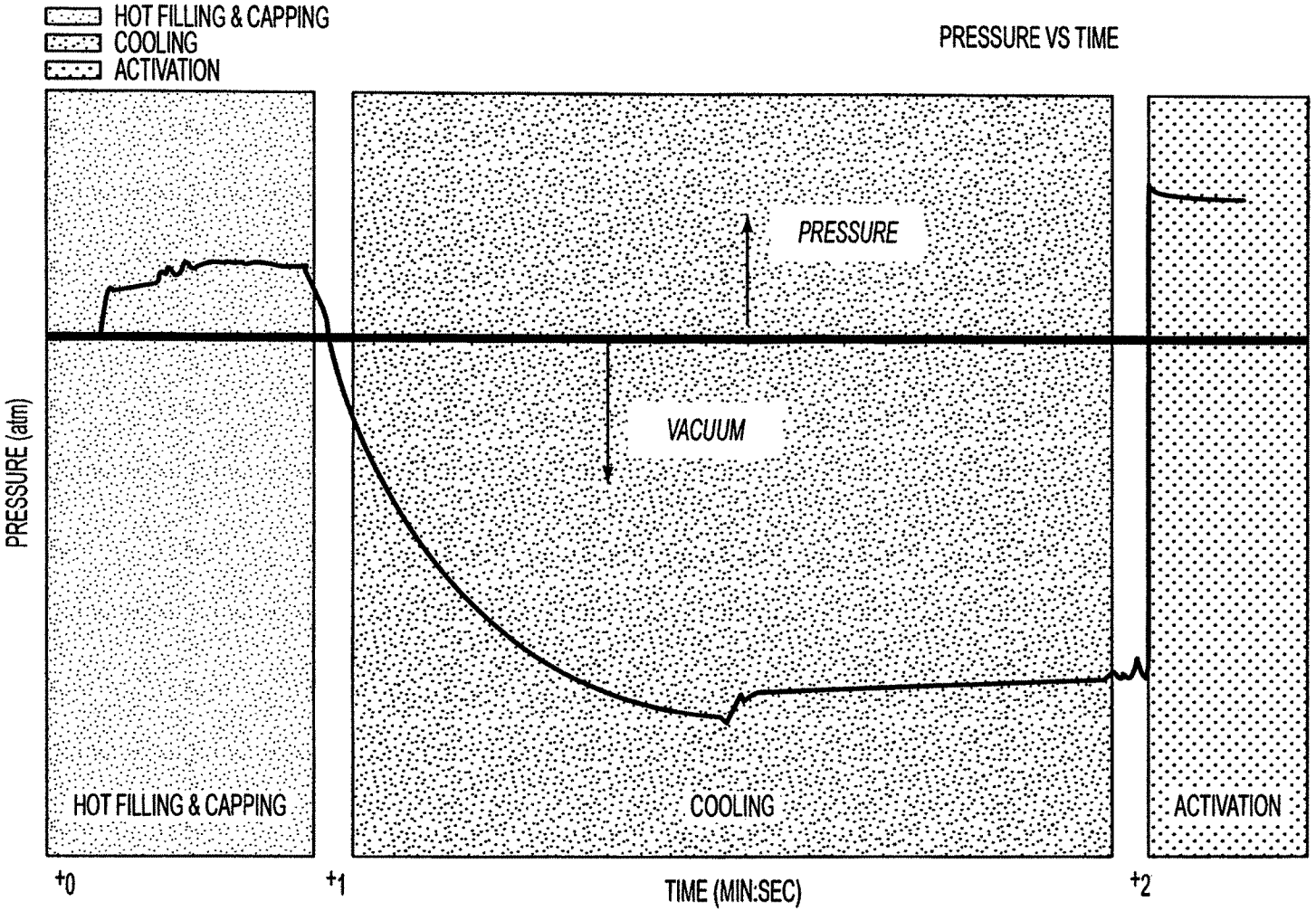
FIG. 9 is a pressure verses time graph for a container undergoing a method of processing a container according to the present invention.

FIG. 9 is a graph of the internal pressures experienced by a container undergoing an exemplary hot-fill process according to the present invention, such as a process similar to the one described above in connection with FIGS. 8A-C. When the container is initially hot filled and capped, at time $t_0$, a positive pressure exists within the sealed container, as shown on the left side of FIG. 9. After the container has been hot filled and capped, it can be left to cool, for example, to room temperature, at time $t_1$. This cooling of the liquid contents usually causes the liquid contents to undergo volume reduction, which can create a vacuum (negative pressure) within the sealed container, as represented by the central portion of FIG. 9. This vacuum can cause the container to distort undesirably. As discussed previously, the pressure panel can be configured and dimensioned to reduce the internal volume of the container by an amount sufficient to eliminate the vacuum within the container, and moreover, to produce a predetermined amount of positive pressure inside the container. Thus, as shown on the right side of the graph in FIG. 9, when the pressure panel is activated, at time $t_2$, the internal pressure sharply increases until it reaches the predetermined pressure level. From this point on, the pressure preferably remains at or near the predetermined level until the container is opened.

Referring to FIGS. 10-13, additional containers according to the present invention are shown in side view. Similar to container 10 of FIGS. 1-7, containers 110, 210, and 310 generally include an upper portion 112, 212, 312, 412 including a finish 114, 214, 314, 414 adapted to receive a closure. The containers 110, 210, 310, 410 also include a lower portion 116, 216, 316, 416 including a base 118, 218, 318, 418, and a sidewall 120, 220, 320, 420 extending between the upper portion and lower portion. The upper portion, lower portion, and sidewall generally define an interior volume of the container. Similar to container 10 of FIGS. 1-7, containers 110, 210, 310, and 410 can each include a pressure panel (see pressure panel 422 shown in FIG. 13; the pressure panel is not visible in FIGS. 10-12) that can be activated to reduce the internal volume of the container, as described above.

Containers according to the present invention may have sidewall profiles that are optimized to compensate for the pressurization imparted by the pressure panel. For example, containers 10, 110, 210, 310, and 410, and particularly the sidewalls 20, 120, 220, 320, 420, may be adapted to expand radially outwardly in order to absorb some of the pressurization. This expansion can increase the amount of pressurization that the container can withstand. This can be advantageous, because the more the container is pressurized, the longer it will take for pressure loss (e.g., due to vapor transmission through the sidewall) to reduce the strengthening effects of the pressurization. The increased pressurization also increases the stacking strength of the container.

Figure 12:
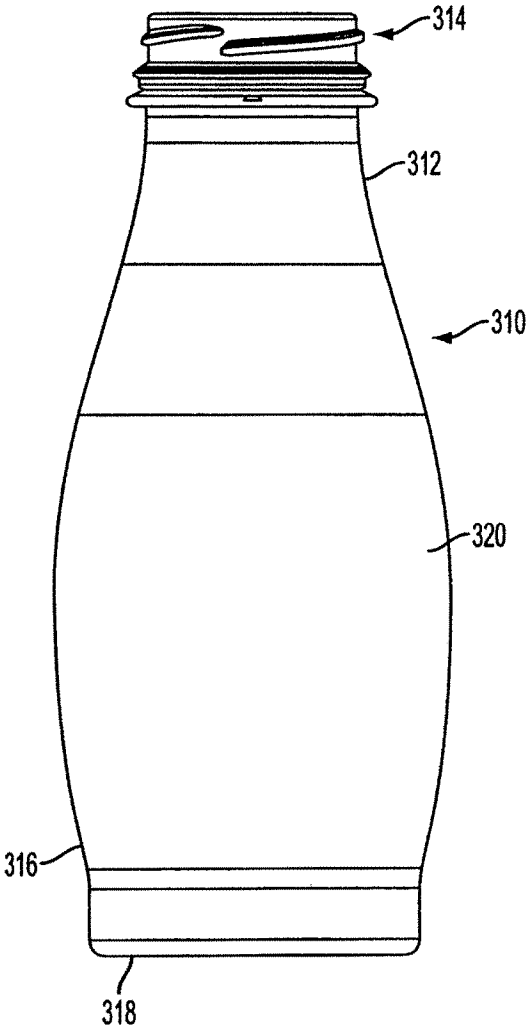
FIG. 12 is a side view of another alternative embodiment of a plastic container according to the present invention.
Figure 11:
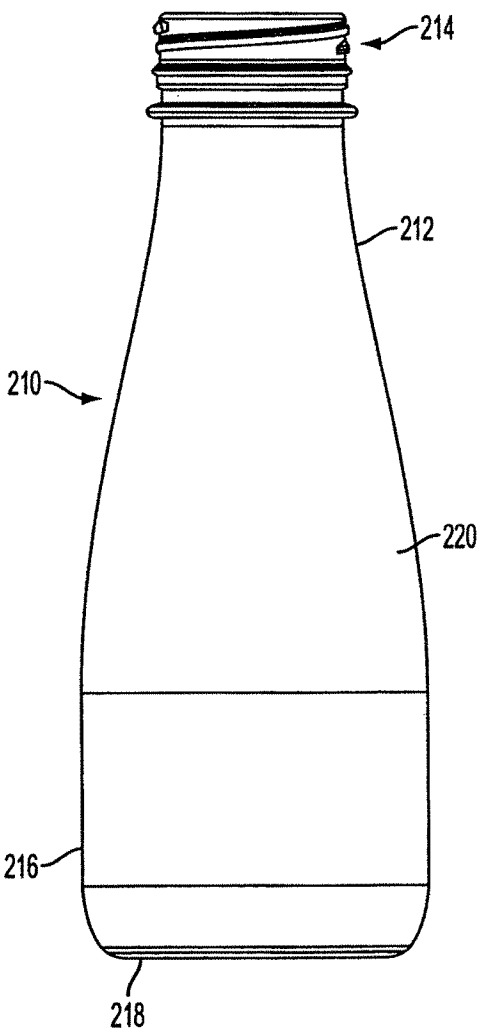
FIG. 11 is a side view of another alternative embodiment of a plastic container according to the present invention.
Figure 10:
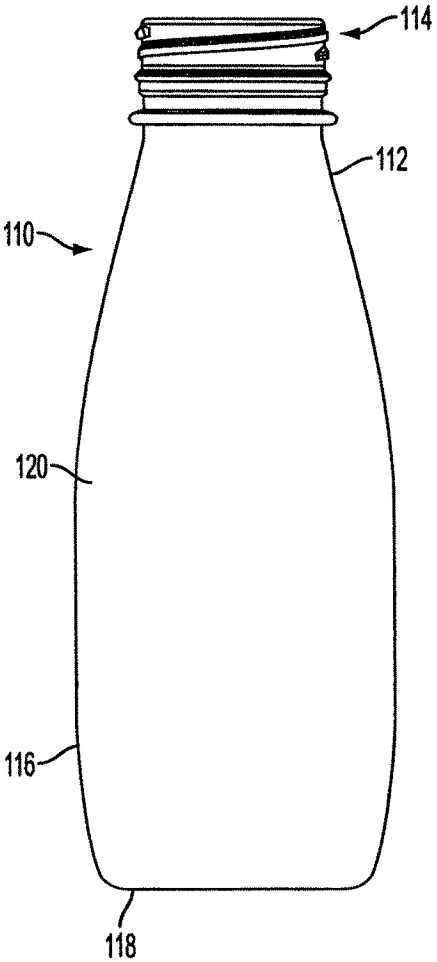
FIG. 10 is a side view of an alternative embodiment of a plastic container according to the present invention.

Referring to FIGS. 10-12, it has been found that containers including a vertical sidewall profile that is teardrop shaped or pendant shaped (at least in some vertical cross-sections) are well suited for the above-described radial-outward expansion. Referring to FIG. 4, other vertical sidewall profiles including a S-shaped or exaggerated S-shaped bend may be particularly suited for radial-outward expansion as well, although other configurations are possible.

Referring to FIGS. 13A-14B, it has also been found that containers having a sidewall that is fluted (at least prior to filling, capping, and activating the pressure panel) are well suited for the above-described radial-outward expansion. For example, with reference to FIGS. 13A-C, the sidewall 420 can be radially recessed from touch zones 450. As will be understood by those skilled in the art, the touch zones 450 provide regions of bottle to bottle contact and the recessed sidewall is therefore protected during such contact. As will be further understood by those skilled in the art, the touch zones 450 may further include annular concave hoop ring portions 470 and 480, to provide strength and resistance to deformation while the container is under vacuum. The sidewall 420 may include a plurality of flutes 460 adapted to expand radially-outwardly under the pressure imparted by the pressure panel 422. In the exemplary embodiment shown, the flutes 460 extend substantially vertically (i.e., substantially parallel to the container's longitudinal axis A), however other orientations of the flutes 460 are possible. The exemplary embodiment shown includes ten flutes 460 (visible in the cross-sectional view of FIG. 14A), however, other numbers of flutes 460 are possible.

Figure 14A:
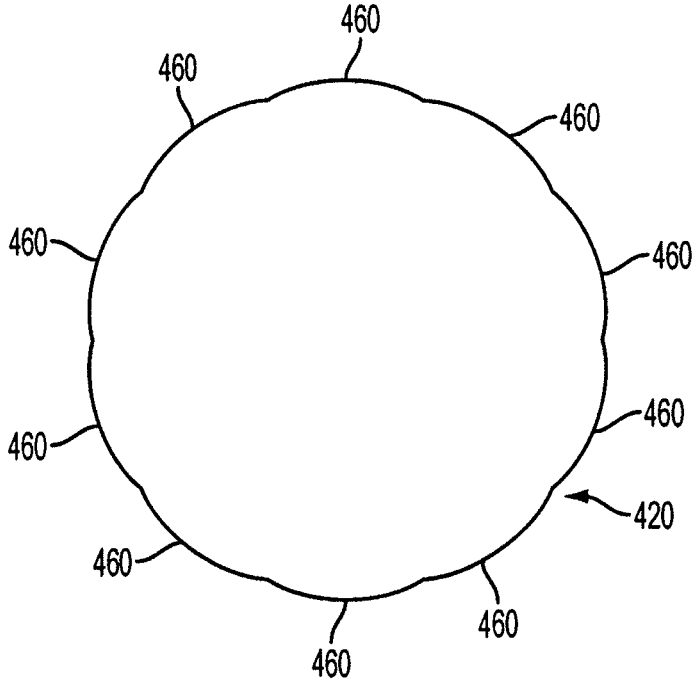
FIG. 14A is a cross-sectional view of the plastic container of FIG. 13A, taken along line 14A, 14B of FIG. 13, prior to filling and capping the container.
Figure 14B:
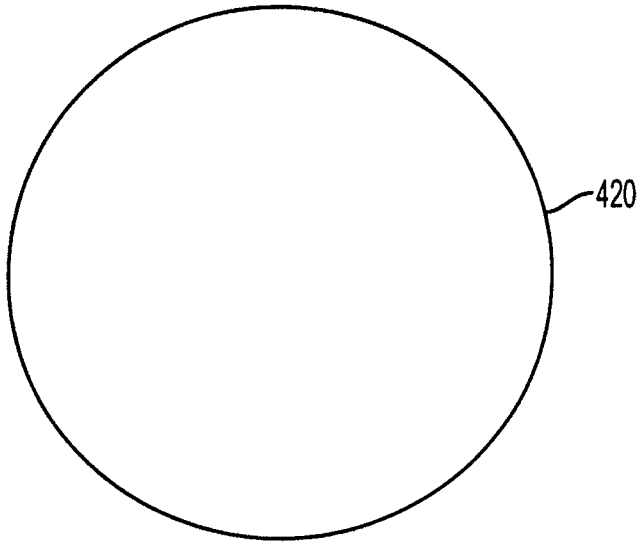
FIG. 14B is a cross-sectional view of the plastic container of FIG. 13A, taken along line 14A, 14B of FIG. 13A, after filling, capping, and activating the container.

FIG. 14A is a cross-sectional view of the sidewall 420 prior to activating the pressure panel 422. As previously described, activating the pressure panel 422 creates a positive pressure within the container. This positive pressure can cause the sidewall 420 to expand radially-outwardly in response to the positive pressure, for example, by reducing or eliminating the redundant circumferential length contained in the flutes 460. FIG. 14B is a cross-sectional view of the sidewall 420 after the pressure panel has been activated. As can be seen, the redundant circumferential length previously contained in the flutes 460 has been substantially eliminated, and the sidewall 420 has bulged outward to assume a substantially circular cross-section.

One of ordinary skill in the art will know that the above-described sidewall shapes (e.g., teardrop, pendant, S-shaped, fluted) are not the only sidewall configurations that can be adapted to expand radially outwardly in order to absorb some of the pressurization created by the pressure panel. Rather, one of ordinary skill in the art will know from the present application that other shapes and configurations can alternatively be used, such as concertina and/or faceted configurations.

As will be seen particularly in FIG. 38, horizontally aligned rib or flute structures 461 may be provided as an alternative to vertically aligned flutes of FIGS. 13A-14B. More importantly, immediately adjacent the annular standing ring 28 there may be an instep or upward recess 8 connected to the pressure panel 22. A decoupling or hinge structure 13 may join the pressure panel 22 to the instep 8 and may be a substantially flat, non-ribbed region. Many other configurations of hinge structure are envisioned, however, and it will be appreciated that alternative structures could be provided for connecting or hinging the pressure panel 22 to the instep 8. The instep 8 may be recessed to such an extent that the entire pressure panel portion is substantially or completely contained above the standing ring 28 prior to folding inwardly. An upward recess 8 can also be used with containers having vertically aligned flutes as shown in FIGS. 13B-C. Similar to other embodiments, the pressure panel 22 may include a control portion 70 and an initiator portion 80.

Figure 16:
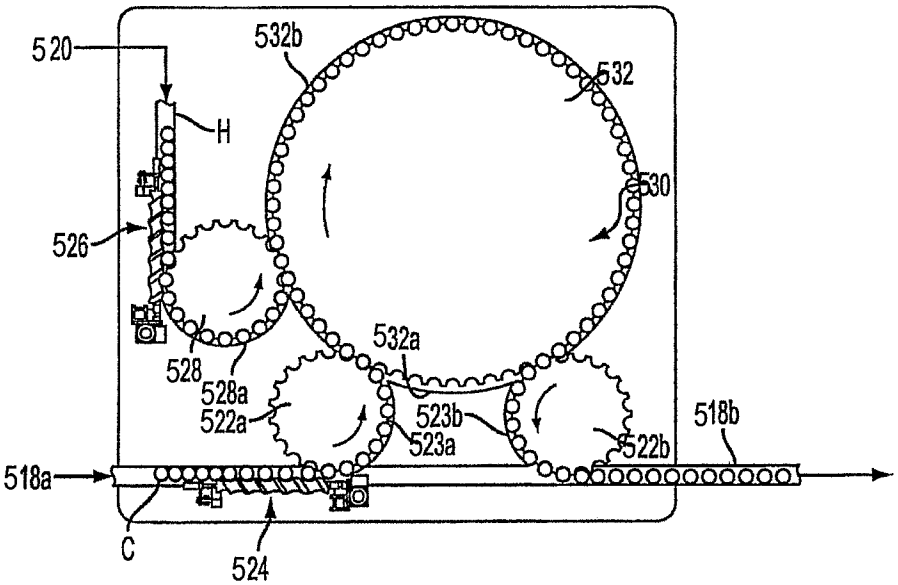
FIG. 16 is a schematic plan view of an exemplary handling system that combines single containers with a container holding device according to the invention.

The processing of a container, for example in the manner described with respect to FIGS. 8A-8C, can be accomplished as part of a conveyor system. In one such system, as seen in FIG. 16, containers C can be conveyed singularly to a combining system that combines container holding devices and containers. The combining system of FIG. 16 includes a container in-feed 518*a* and a container holding device in-feed 520. As will be more fully described below, this system may be one way to stabilize containers with projected bottom portions that are unable to be supported by their bottom surfaces alone. Container in-feed 518*a* includes a feed scroll assembly 524, which feeds and spaces the containers at the appropriate spacing for merging containers C into a feed-in wheel 522*a*. Wheel 522*a* comprises a generally star-shaped wheel, which feeds the containers to a main turret system 530 and includes a stationary or fixed plate 523*a* that supports the respective containers while containers C are fed to turret system 530, where the containers are matched up with a container holding device H and then deactivated to have a projecting bottom portion.

Similarly, container holding devices H are fed in and spaced by a second feed scroll 526, which feeds in and spaces container holding devices H to match the spacing on a second feed-in wheel 528, which also comprises a generally star-shaped wheel. Feed-in wheel 528 similarly includes a fixed plate 528*a* for supporting container holding devices H while they are fed into turret system 530. Container holding devices H are fed into main turret system 530 where containers C are placed in container holding devices H, with holding devices H providing a stable bottom surface for processing the containers. In the illustrated embodiment, main turret system 530 rotates in a clock-wise direction to align the respective containers over the container holding devices fed in by star wheel 528. However, it should be understood that the direction of rotation may be changed. Wheels 522*a* and 528 are driven by a motor 529 (FIG. 17), which is drivingly coupled, for example, by a belt or chain or the like, to gears or sheaves mounted on the respective shafts of wheels 522*a* and 528.

Container holding devices H comprise disc-shaped members with a first recess with an upwardly facing opening for receiving the lower end of a container and a second recess with downwardly facing opening, which extends upwardly from the downwardly facing side of the disc-shaped member through to the first recess to form a transverse passage through the disc-shaped member. The second recess is smaller in diameter than the first so as to form a shelf in the disc-shaped member on which at least the perimeter of the container can rest. As noted above, when a container is deactivated, its vacuum panels will be extended or projecting from the bottom surface. The extended or projecting portion is accommodated by the second recess. In addition, the containers can then be activated through the transverse passage formed by the second recess, as will be appreciated more fully in reference to FIGS. 8A-C and 21-22 described herein.

In order to provide extra volume and accommodation of pressure changes needed when the containers are filled with a hot product, such as a hot liquid or a partly solid product, the inverted projection of the blow-molded containers should be pushed back out of the container (deactivated). For example, a mechanical operation employing a rod that enters the neck of the blow-molded container and pushes against the inverted projection of the blow-molded container causing the inverted projection to move out and project from the bottom of the base, as shown in FIGS. 6, 8B and 21-22. Alternatively, other methods of deploying the inverted projection disposed inside a blow-molded container, such as injecting pressurized air into the blow-molded container, may be used to force the inverted projection outside of the container. Thus, in this embodiment, the blow-molded projection is initially inverted inside the container and then, a repositioning operation pushes the inverted projection so that it projects out of the container.

Figure 17:
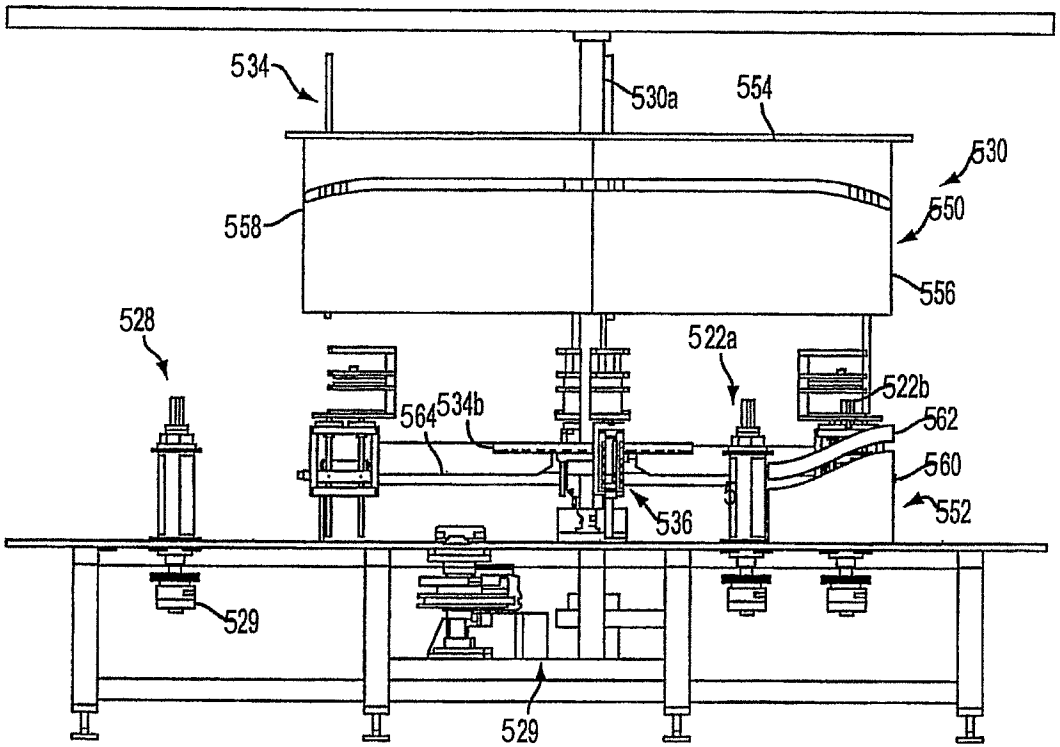
FIG. 17 is a front side elevation view of the handling system of FIG. 16.
Figure 18:
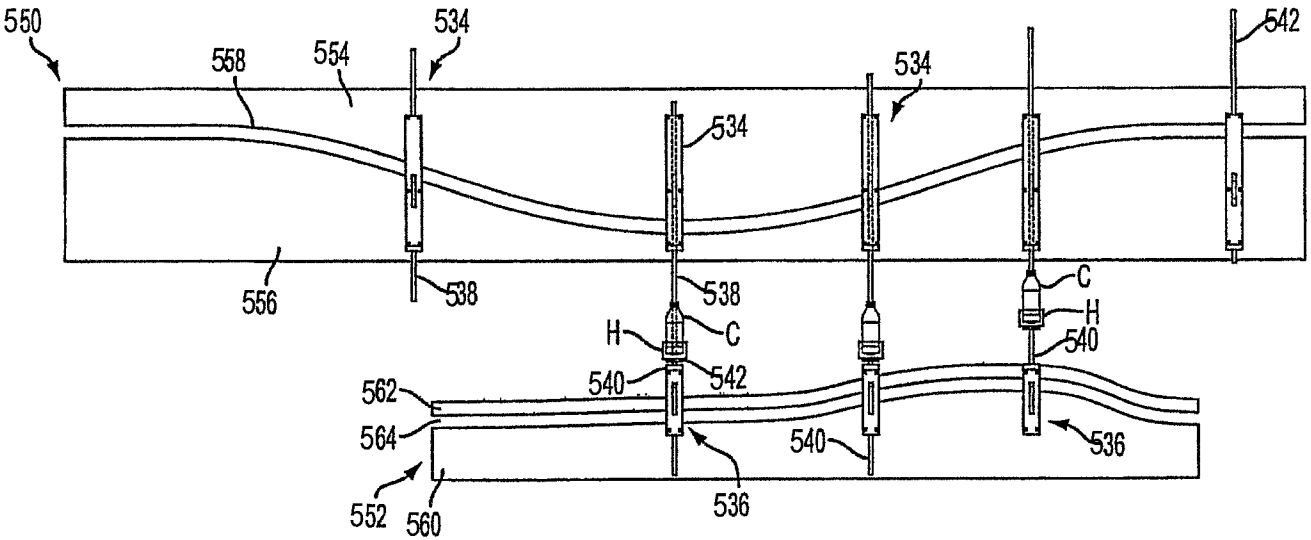
FIG. 18 is an unfolded elevation view of a section of the combining portion of the handling system of FIG. 17 illustrating the movement of the actuators.

Referring to FIG. 17, main turret system 530 includes a central shaft 530*a*, which supports a container carrier wheel 532, a plurality of radially spaced container actuator assemblies 534 and, further, a plurality of radially spaced container holder actuator assemblies 536 (FIG. 18). Actuator assemblies 534 deactivate the containers (extend the inverted projection outside the bottom surface of the container), while actuator assemblies 536 support the container holding devices and containers. Shaft 530*a* is also driven by motor 529, which is coupled to a gear or sheave mounted to shaft 530*a* by a belt or chain or the like. In addition, main turret system 530 includes a fixed plate 532*a* for supporting the containers as they are fed into container carrier wheel 532. However, fixed plate 532*a* terminates adjacent the feed-in point of the container holding devices so that the containers can be placed or dropped into the container holding devices under the force of gravity, for example. Container holding devices H are then supported on a rotating plate 532*b*, which rotates and conveys container holding devices H to discharge wheel 522*b*, which thereafter feeds the container holding devices and containers to a conveyor 518*b*, which conveys the container holding devices and containers to a filling system. Rotating plate 532*b* includes openings or is perforated so that the extendable rods of the actuator assemblies 536, which rotate with the rotating plate, may extend through the rotating plate to raise the container holding devices and containers and feed the container holding devices and containers to a fixed plate or platform 523*b* for feeding to discharge wheel 522*b*.

As best seen in FIG. 18, each actuator assembly 534, 536 is positioned to align with a respective container C and container holding device H. Each actuator assembly 534 includes an extendable rod 538 for deactivating containers C, as will be described below. Each actuator assembly 536 also includes an extendable rod 540 and a pusher member 542, which supports a container holding device, while a container C is dropped into the container holding device H and, further supports the container holding device H while the container is deactivated by extendable rod 538. To deactivate a container, actuator assembly 534 is actuated to extend its extendable rod 538 so that it extends into the container C and applies a downward force onto the invertible projection (512) of the container to thereby move the projection to an extended position to increase the volume of container C for the hot-filling and post-cooling process that follows. After rod 538 has fully extended the invertible projection of a container, rod 538 is retracted so that the container holding device and container may be conveyed for further processing.

Again as best seen in FIG. 18, while rod 538 is retracted, extendable rod 540 of actuator 536 is further extended to raise the container holding device and container to an elevation for placement on fixed plate or platform 523*b* of discharge wheel 522*b*. Wheel 522*b* feeds the container holding device and container to an adjacent conveyor 518*b*, which conveys the container holding device and container to filling portion 516 of the container processing system. Discharge wheel 522*b* is similar driven by motor 529, which is coupled to a gear or sheave mounted on its respective shaft.

Referring again to FIGS. 17 and 18, main turret assembly 530 includes an upper cam assembly 550 and a lower cam assembly 552.

Cam assemblies 550 and 552 comprise annular cam plates that encircle shaft 530a and actuator assemblies 534 and 536. The cam plates provide cam surfaces to actuate the actuator assemblies, as will be more fully described below. Upper cam assembly 550 includes upper cam plate 554 and a lower cam plate 556, which define there between a cam surface or groove 558 for guiding the respective extendable rods 538 of actuator assemblies 534. Similarly, lower cam assembly 552 includes a lower cam plate 560 and an upper cam plate 562 which define there between a cam surface or groove 564 for guiding extendable rods 540 of actuator assemblies 536. Mounted to extendable rod 538 may be a guide member or cam follower, which engages cam groove or surface 558 of upper cam assembly 550. As noted previously, actuator assemblies 534 are mounted in a radial arrangement on main turret system 530 and, further, are rotatably mounted such that actuator assemblies 534 rotate with shaft 530*a* and container holder wheel 532. In addition, actuator assemblies 534 may rotate in a manner to be synchronized with the in-feed of containers C. As each of the respective actuator assemblies 534 is rotated about main turret system 530 with a respective container, the cam follower is guided by groove 558 of cam assembly 550, thereby raising and lowering extendable member 538 to deactivate the containers, as previously noted, after the containers are loaded into the container holding devices.

If the container holding devices are not used, the containers according to the invention may be supported at the neck of each container during the filling and capping operations to provide maximum control of the container processes. This may be achieved by rails R, which support the neck of the container, and a traditional cleat and chain drive, or any other known like-conveying modes for moving the containers along the rails R of the production line (see FIG. 15). The extendable projection 512 may be positioned outside the container C by an actuator as described above.

Figure 15:
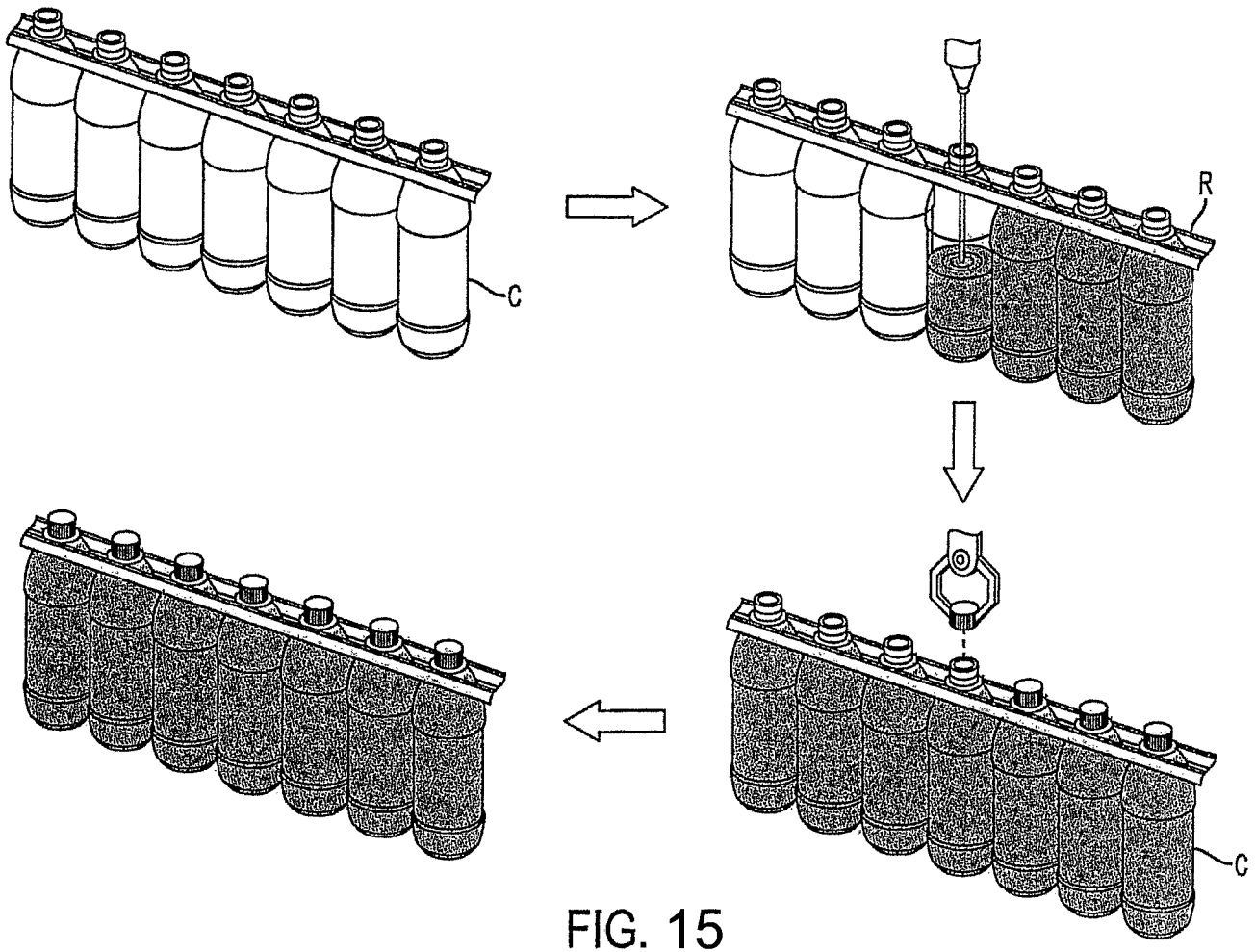
FIG. 15 schematically depicts containers being filled and capped.

The process of repositioning the projection outside of the container preferably should occur right before the filling of the hot product into the container. According to one embodiment of the invention, the neck of a container would be sufficiently supported by rails so that the repositioning operation could force or pop the inverted base outside of the container without causing the container to fall off the rail conveyor system. In some instances, it may not be necessary to invert the projection prior to leaving the blow-molding operation and these containers are moved directly to a filling station. The container with an extended projection, still supported by its neck, may be moved by a traditional neck rail drive to the filling and capping operations, as schematically shown in FIG. 15.

Figure 19:
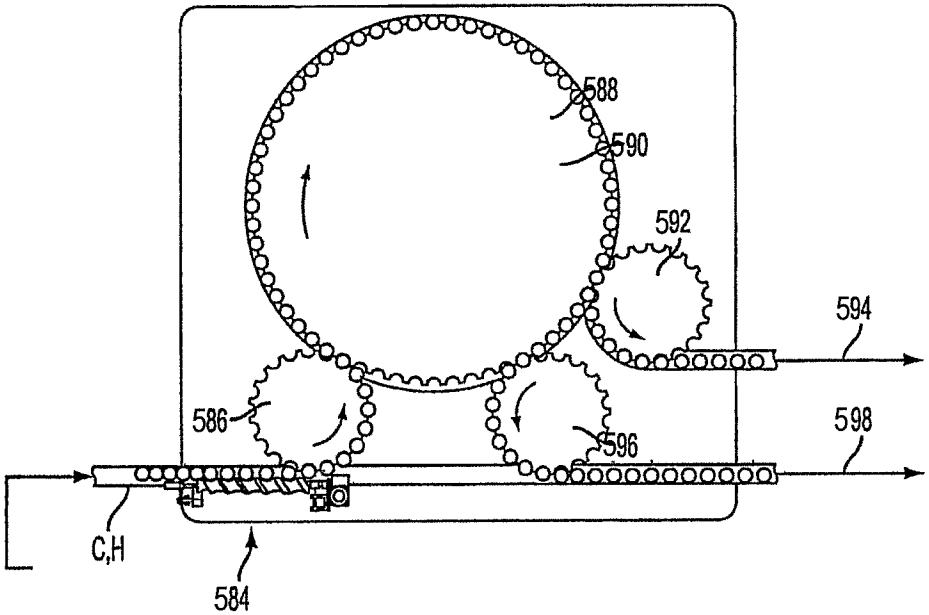
FIG. 19 is a schematic plan view of a second embodiment of an activation portion of the handling system of the present invention.
Figure 20:
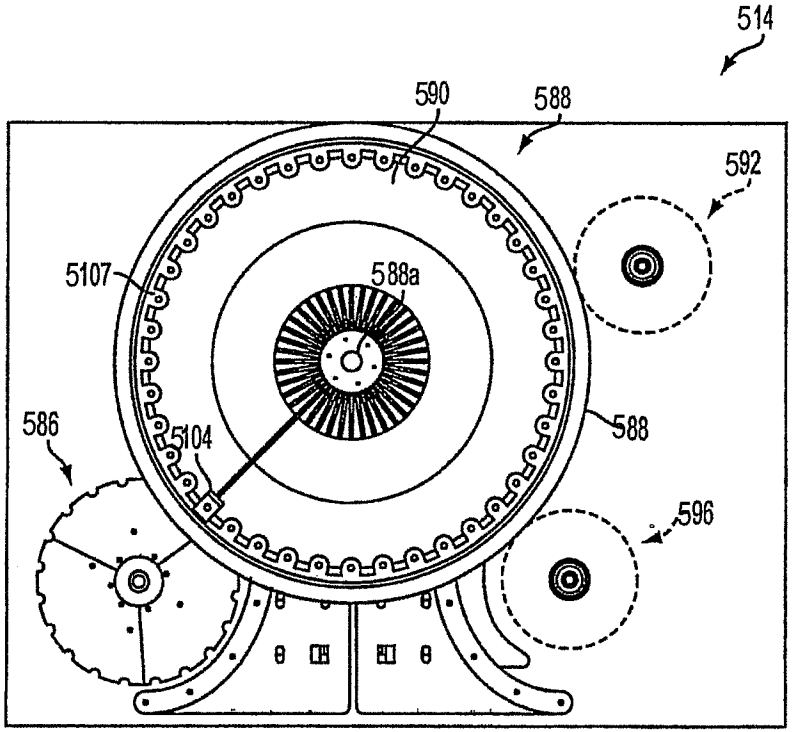
FIG. 20 is a detailed plan view of the activation portion of the handling system of FIG. 19.

Referring to FIGS. 19 and 20, one system for singularly activating containers C includes a feed-in scroll assembly 584, which feeds and, further, spaces the respective container holding devices and their containers at a spacing appropriate for feeding into a feed-in wheel 586. Feed-in wheel 586 is of similar construction to wheel 522*b* and includes a generally star-shaped wheel that feeds-in the container holders and containers to turret assembly 588. Turret assembly 588 is of similar construction to turret assembly 530 and includes a container holder wheel 590 for guiding and moving container holding devices H and containers C in a circular path and, further, a plurality of actuator assemblies 5104 and 5106 (see FIG. 21) for removing the containers from the container holders and for activating the respective containers, as will be more fully described below. After the respective containers have been activated and the respective containers removed from the container holding devices, the holders are discharged by a discharge wheel 592 to conveyor 594 and the containers are discharged by a discharge wheel 596 to a conveyor 598 for further processing. Wheels 586, 592, and 596 may be driven by a common motor, which is drivingly coupled to gears or sheaves mounted to the respective shafts of wheels 586, 592, and 596.

As previously noted, turret assembly 588 is of similar construction to turret assembly 530 and includes container holder wheel 590, upper and lower cam assemblies 5100 and 5102, respectively, a plurality of actuator assemblies 5104 for griping the containers, and a plurality of actuator assemblies 5106 for activating the containers. In addition, turret system 588 includes a support plate 5107, which supports the container holders and containers as they are moved by turret system 588. As best seen in FIG. 20, container holder wheel 590, actuator assemblies 5104, actuator assemblies 5106, and plate 5107 are commonly mounted to shaft 588*a* so that they rotate in unison. Shaft 588*a* is similarly driven by the common motor, which is drivingly coupled to a gear or sheave mounted on shaft 588*a*.

Figure 21:
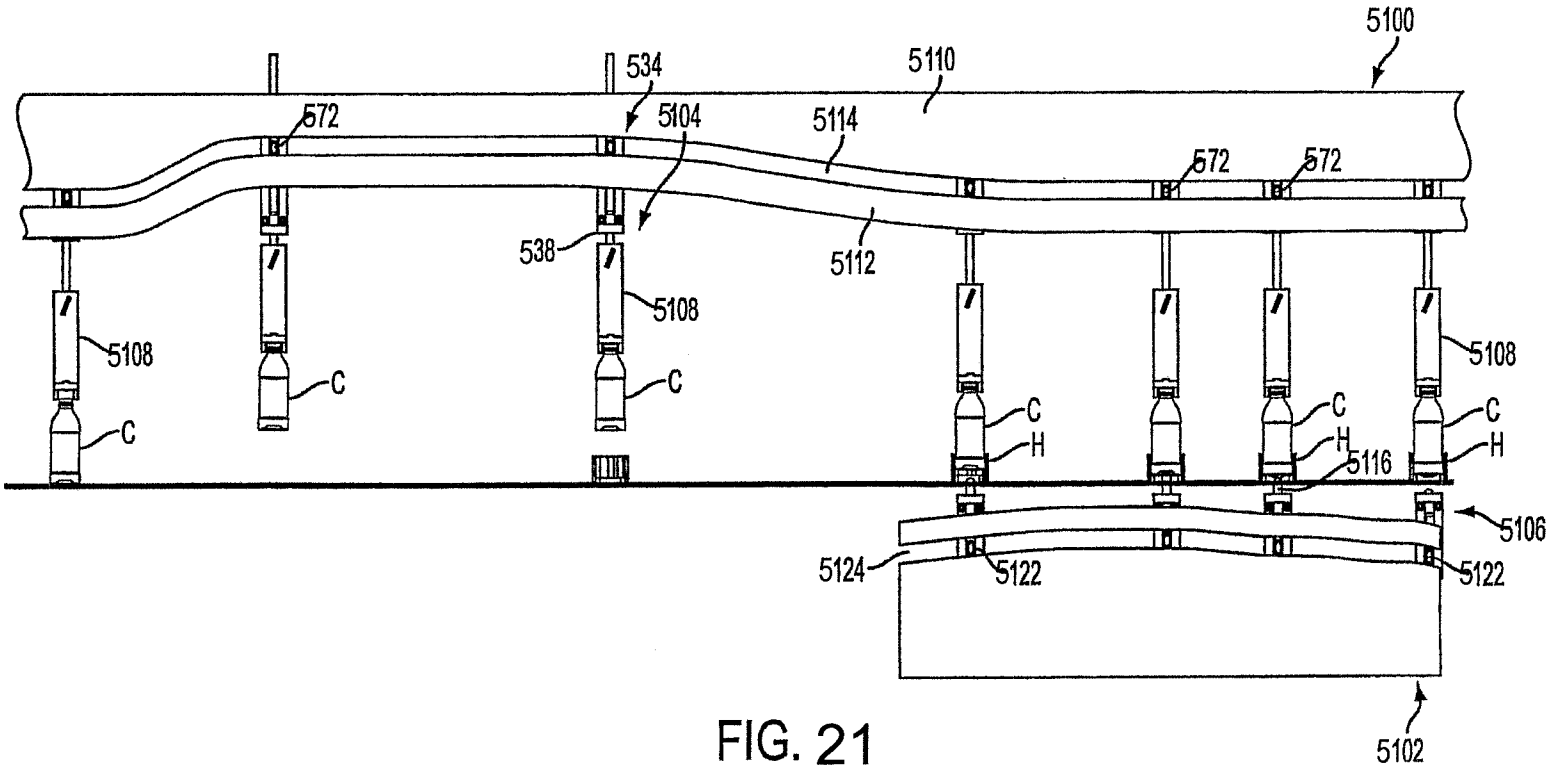
FIG. 21 is an unfolded elevation view of a section of the activation portion of FIG. 19 illustrating the activation of the container and the removal of the container from the container holding device.
Figure 22:
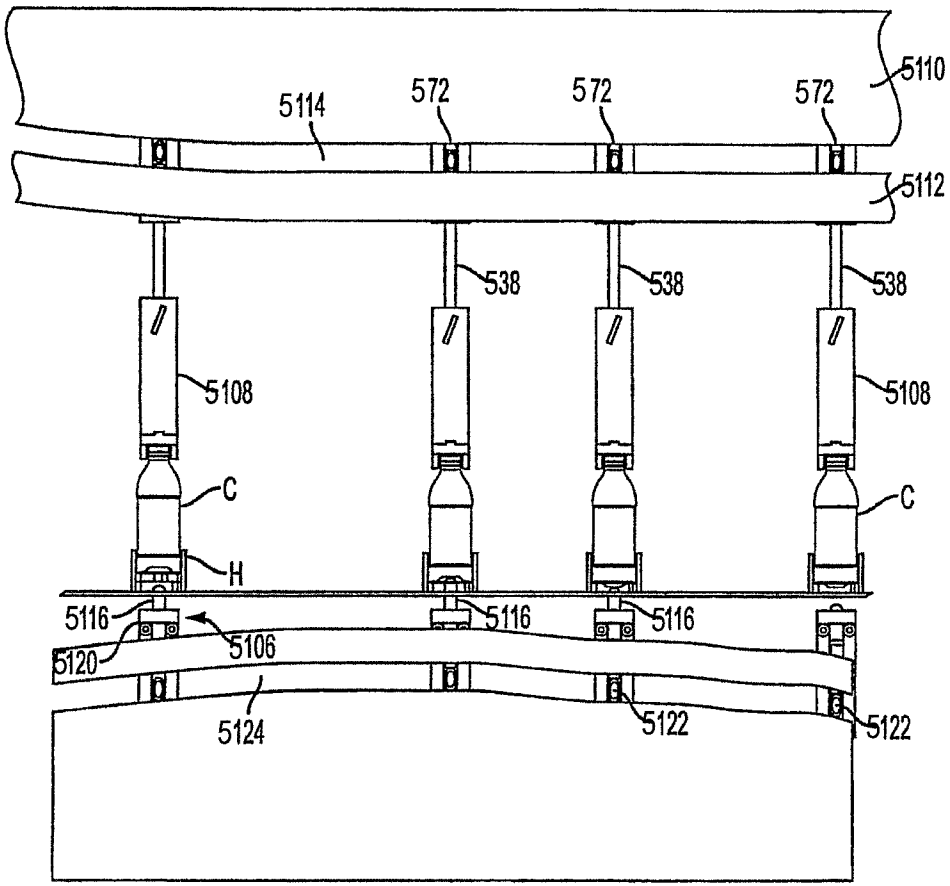
FIG. 22 is an enlarged view of a section of the activation portion of FIG. 21.
Figure 23:
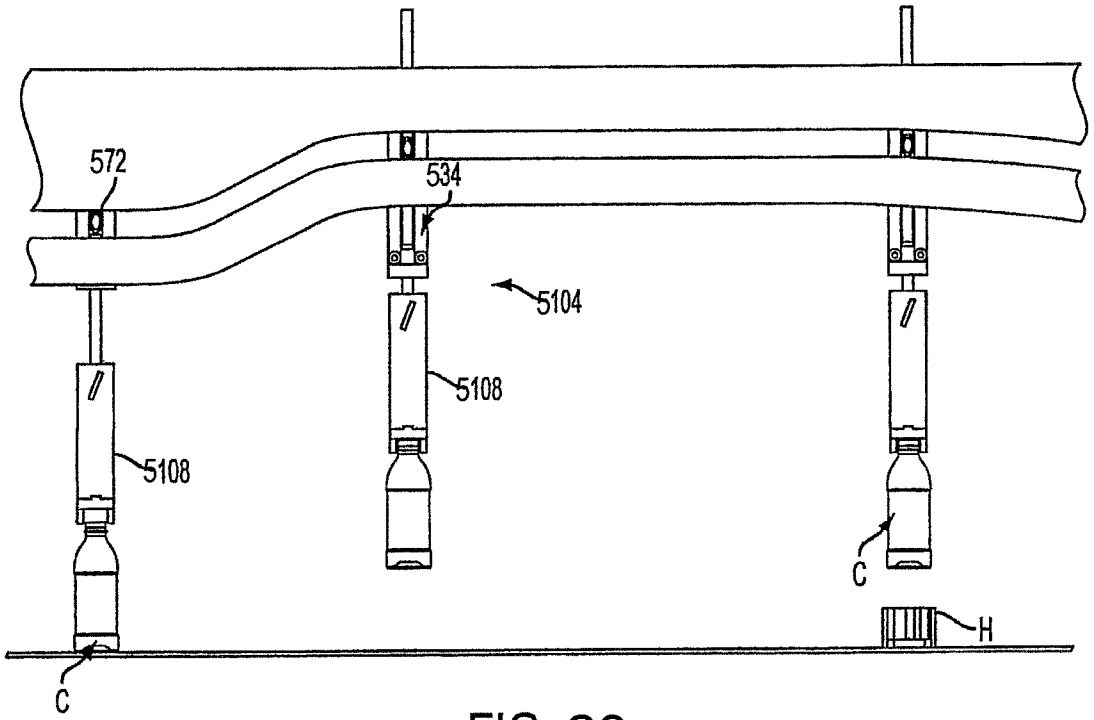
FIG. 23 is an enlarged view of the container holder removal section of FIG. 21.

Looking at FIGS. 21-23, actuator assemblies 5104 and 5106 are similarly controlled by upper and lower cam assemblies 5100 and 5102, to remove the containers C from the container holding devices H and activate the respective containers so that the containers generally assume their normal geometrically stable configuration wherein the containers can be supported from their bottom surfaces and be conveyed on a conventional conveyor. Referring to FIG. 21, each actuator assembly 5104 includes actuator assembly 534 and a container gripper 5108 that is mounted to the extendable rod 538 of actuator assembly 534. As would be understood, grippers 5108 are, therefore, extended or retracted with the extension or retraction of extendable rods 538, which is controlled by upper cam assembly 5100.

Similar to upper cam assembly 550, upper cam assembly 5100 includes an upper plate 5110 and a lower plate 5112, which define therebetween a cam surface or recess 5114, which guides guide members 572 of actuator assemblies 5104 to thereby extend and retract extendable rods 538 and in turn to extend and retract container grippers 5108. As the containers are conveyed through turret assembly 588, a respective gripper 5108 is lowered onto a respective container by its respective extendable rod 538. Once the gripper is positioned on the respective container, actuator assemblies 5106 are then actuated to extend their respective extendable rods 5116, which extend through plate 5107 and holders H, to apply a compressive force onto the invertible projections of the containers to move the projections to their recessed or retracted positions to thereby activate the containers. As would be understood, the upward force generated by extendable rod 5116 is counteracted by the downward force of a gripper 5108 on container C. After the activation of each container is complete, the container then can be removed from the holder by its respective gripper 5108.

Referring to FIGS. 21-22, each actuator assembly 5106 is of similar construction to actuator assemblies 534 and 536 and includes a housing 5120, which supports extendable rod 5116. Similar to the extendable rods of actuator assemblies 534 and 536, extendable rod 5116 includes mounted thereto a guide 5122, which engages the cam surface or recess 5124 of lower cam assembly 5102. In this manner, guide member 5122 extends and retracts extendable rod 5116 as it follows cam surface 5124 through turret assembly 588. As noted previously, when extendable rod 5116 is extended, it passes through the base of container holding device H to extend and contact the lower surface of container C and, further, to apply a force sufficient to compress or move the invertible projection to its retracted position so that container C can again resume its geometrically stable configuration for normal handling or processing.

The physics of manipulating the activation panel P or extendable rod 5116 is a calculated science recognizing 1) Headspace in a container; 2) Product density in a hot-filled container; 3) Thermal differences from the fill temperature through the cooler temperature through the ambient storage temperature and finally the refrigerated temperature; and 4) Water vapor transmission. By recognizing all of these factors, the size and travel of the activation panel P or extendable rod 5116 is calculated so as to achieve predictable and repeatable results. With the vacuum removed from the hot-filled container, the container can be light-weighted because the need to add weight to resist a vacuum or to build vacuum panels is no longer necessary. Weight reduction of a container can be anticipated to be approximately 10%.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

The invention claimed is:

1. A system for handling containers, each said container having a longitudinal axis, an upper portion having an opening into the container, a body portion extending from the upper portion to a lower portion, the body portion including portions that are strengthened against deformation, said strengthened portions including a first concave hoop ring or rib structure and a second concave hoop ring or rib structure, and an annular sidewall portion that deforms inwardly and outwardly arranged between the first and the second concave hoop rings or ribs, the lower portion including a base, the base closing off an end of the container and providing a standing surface, the container having at least one substantially transversely oriented pressure panel located in the lower portion, wherein the pressure panel includes a portion inclined outwardly at an angle of greater than 10 degrees relative to a plane orthogonal to the longitudinal axis when in a first, outwardly inclined position, the pressure panel being adapted to be inverted and repositioned from a first position to a second position, the system comprising:

filling means for filling the containers with a product, the product being at an elevated temperature;

sealing means for sealing the filled containers using a cap;

vacuum creating means for creating a vacuum in each of the filled and sealed containers by cooling;

conveying means for conveying the containers having vacuums created therein with the pressure panel in the first position with the portion of the pressure panel inclined outwardly at an angle of greater than 10 degrees relative to a plane orthogonal to the longitudinal axis; and repositioning means for repositioning the pressure panel from the first position with the portion of the pressure panel inclined outwardly at an angle of greater than 10 degrees relative to a plane orthogonal to the longitudinal axis to an inverted second position to reduce the vacuum, wherein the second position is toward the opening into the container; wherein the repositioning means comprises a mechanical pusher or the like to engage an inwardly recessed central portion of a centrally located push-up portion.

2. The system of claim 1, wherein the container body includes a portion that deforms inwardly and reduces a first portion of the vacuum pressure created during the cooling of the container.

3. The system of claim 2, wherein repositioning the pressure panel reduces a second portion of the vacuum pressure.

4. The system of claim 1, wherein the pressure panel comprises a centrally located push-up portion.

5. The system of claim 4 wherein the pressure panel is connected by a hinge to an instep recessed from the standing surface.

6. The system of claim 5, wherein the pressure panel is repositioned about the hinge element without substantial repositioning of the instep.

7. The system of claim 1 wherein the container is conveyed with the standing surface on a flat surface.

8. The system of claim 1, wherein the pressure panel extends between the standing surface and a centrally located push-up portion, wherein the pressure panel is circumscribed by an instep, wherein the instep is inwardly recessed from the standing surface to such an extent that the entire pressure panel is contained above the standing surface, and wherein the repositioning means engages with an inwardly recessed central portion of the push up portion above the level of the standing surface, and repositions the pressure panel about the instep substantially without repositioning the instep.

9. A system for processing a pre-formed plastic container filled with a hot product, the container having a longitudinal axis, the system comprising:

hot filling means for filling a rigid container body of the pre-formed plastic container with the hot product in a production line, the rigid container body having a surface surrounding an interior of the rigid container body and having a closed base comprising a standing surface and a centrally located push-up portion configured to receive a mechanical device, the base also having a pressure panel that is invertible from an outwardly inclined position to an inwardly inclined position, the pressure panel extending between the standing surface and the push-up, wherein the pressure panel is circumscribed by a hinge, and wherein the pressure panel includes a portion inclined outwardly at an angle of greater than 10 degrees relative to a plane orthogonal to the longitudinal axis when in the outwardly inclined position;

means for capping a neck of the filled rigid container body with a cap in the next operation of the production line;

means for conveying through the production line the pre-formed plastic container having the pressure panel in the outward position;

means for cooling the rigid container body of the pre-formed plastic container filled with the hot product; and means for pushing the pressure panel from the outwardly inclined position of the cooled rigid container body into the inwardly inclined position within the interior of the rigid container; wherein the means for pushing the pressure panel from the outwardly inclined position to the inwardly inclined position within the cooled container body is to position a mechanical rod or punch-like device underneath a container.

10. The system of claim 9, wherein the base includes an instep connected by the hinge structure to the outwardly inclined pressure panel before the filling begins.

11. The system of claim 10, wherein the instep is inwardly recessed from the standing surface to such an extent that the entire pressure panel is contained above the standing surface.

12. The system of claim 9, wherein a portion of the sidewall responds to vacuum pressure during cooling of the container, and pushing the base from the outwardly inclined position to the inwardly inclined position removes at least a portion of the vacuum pressure.

13. The system of claim 9, wherein the pressure panel is substantially transversely oriented, wherein the base includes an instep connected by the hinge to the pressure panel, and wherein the pushing means engages with an inwardly recessed central portion of the push up portion above the level of the standing surface, and repositions the pressure panel about the instep substantially without repositioning the instep.

14. A system comprising:

a plurality of hot-filled and sealed plastic containers, each said plastic container including a body portion and a base portion, the base portion forming a support surface for supporting the container on a substantially flat surface and the base portion having a moveable element arranged at a bottom end thereof, wherein the moveable element includes a portion inclined outwardly at an angle of greater than 10 degrees relative to a plane orthogonal to the longitudinal axis when in a first, outwardly inclined position prior to filling, the moveable element being moveable substantially permanently to remove a vacuum in the container;

a cooler to cool the plurality of hot-filled and sealed containers, said cooling creating a vacuum in each of the hot-filled and sealed containers, each said vacuum causing a temporary deformation of the corresponding container;

a conveyor to convey the containers while temporarily compensating for the vacuums created therein and maintaining stable touch points; and a mechanical activator to activate, after the containers are conveyed, the moveable element of each said container, said activating including moving the moveable element from the first position to a second position substantially permanently to remove a portion of the vacuum, wherein the body portion of each said container includes a first hoop ring, a second hoop ring, and a smooth sidewall between the first and second hoop rings, wherein the conveyance of the containers is such that each said container is in contact with a plurality of other of said containers of said plurality, the first and the second hoop rings for each said container providing for substantially stable touch points for conveyance of the containers.

15. The system of claim 14, wherein the base portion has a recessed instep portion and said activator engages with an inwardly recessed portion of a push up portion above the support surface, and wherein said moving the moveable element is performed substantially without repositioning the instep.

16. A system for handling filled containers, the system comprising:

a plurality of containers, each said container including a body and a base defining an inner volume, the body having a first annular portion, a second annular portion, and a sidewall portion, and the base portion having a moveable element arranged at a bottom end thereof, wherein the moveable element includes a portion inclined outwardly at an angle of greater than 10 degrees relative to a plane orthogonal to the longitudinal axis when in a first, outwardly inclined position;

filling means for filling each of said containers with a product, the product being at an elevated temperature;

capping means for capping and sealing each said filled container with a cap;

cooling means for cooling each said filled and capped container, the cooling creating a vacuum in the container, the vacuum causing temporary distortion of the container, the temporary distortion occurring substantially at the sidewall portion, with the first annular portion and the second annular portion substantially resisting distortion; and handling means for handling each said cooled container temporarily distorted to have one or more substantially stable touch points of the container in contact with corresponding one or more substantially stable touch points of at least one other container, the one or more substantially stable touch points being facilitated by an associated one of the first annular portion and the second annular portion, wherein, in response to hot-filling by said filling means and capping by said capping means, each said container is caused temporarily to deform, the temporary deformation being substantially confined to the sidewall portion, the first annular portion and the second annular portion providing for substantially stable touch points such that no portion of the deformed sidewall portion of any of said containers contacts any other of said containers, and a mechanical activator to activate, after the containers are conveyed, the moveable element of each said container, said activating including moving the moveable element from the first position to a second position substantially permanently to remove a portion of the vacuum.

17. The system of claim 16, wherein said activator engages with an inwardly recessed portion of a push up portion of the base above the standing surface, and wherein said moving the moveable element is performed substantially without repositioning the instep.

* * * * *